US008177351B2

(12) United States Patent
Taniuchi et al.

(10) Patent No.: US 8,177,351 B2
(45) Date of Patent: May 15, 2012

(54) METHOD FOR PRODUCING RECORD PRODUCT, AND INTERMEDIATE TRANSFER BODY AND IMAGE RECORDING APPARATUS USED THEREFOR

(75) Inventors: Hiroshi Taniuchi, Yokohama (JP); Akihiro Mouri, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 958 days.

(21) Appl. No.: 12/162,733

(22) PCT Filed: Jun. 15, 2007

(86) PCT No.: PCT/JP2007/062548

§ 371 (c)(1),
(2), (4) Date: Jul. 30, 2008

(87) PCT Pub. No.: WO2007/145378

PCT Pub. Date: Dec. 21, 2007

(65) Prior Publication Data

US 2009/0027473 A1 Jan. 29, 2009

(30) Foreign Application Priority Data

Jun. 16, 2006 (JP) ..... 2006-168006

(51) Int. Cl.
*B41J 2/01* (2006.01)

(52) U.S. Cl. ..... 347/103; 347/88; 347/89; 347/95; 347/96; 347/65; 347/99; 347/10; 347/101; 347/102

(58) Field of Classification Search ..... 347/88–89, 347/96, 65, 99–103, 95
See application file for complete search history.

(56) References Cited

U.S. PATENT DOCUMENTS

| | | | | |
|---|---|---|---|---|
| 4,538,156 | A | 8/1985 | Durkee et al. | 346/21 |
| 5,099,256 | A | 3/1992 | Anderson | 346/1.1 |
| 5,539,440 | A | 7/1996 | Higuchi et al. | 347/112 |

(Continued)

FOREIGN PATENT DOCUMENTS

| | | |
|---|---|---|
| JP | 62-92849 | 4/1987 |

(Continued)

OTHER PUBLICATIONS

International Preliminary Report on Patentability and the Written Opinion of the International Searching Authority of International Application No. PCT/JP2007/062548 issued on Dec. 31, 2008.

(Continued)

*Primary Examiner* — Ryan Lepisto
*Assistant Examiner* — Guy Anderson
(74) *Attorney, Agent, or Firm* — Fitzpatrick, Cella, Harper & Scinto

(57) ABSTRACT

In the image-recording of an intermediate transfer system applying an ink jet recording method, reactive liquid reactable with ink is properly formed on the intermediate transfer body. By using the intermediate transfer body having a pattern consisting of lyophilic and lyophobic sections on a surface thereof, the reactive liquid is uniformly applied to the intermediate transfer body to form a layer having a suitable thickness. Thereby, it is possible to form an ink image on the intermediate transfer body while preventing the miss landing of ink droplets and restricting the deformation of an ink dots. By transferring this ink image to a recording medium, it is possible to form a high-quality ink image on various kinds of recording media in a stable manner.

8 Claims, 18 Drawing Sheets

U.S. PATENT DOCUMENTS

| | | | | |
|---|---|---|---|---|
| 6,540,344 | B2 | 4/2003 | Kashiwazaki et al. | 347/100 |
| 6,860,593 | B2 | 3/2005 | Kashiwazaki et al. | 347/100 |
| 7,281,790 | B2 | 10/2007 | Mouri et al. | 347/103 |
| 2005/0110855 | A1 | 5/2005 | Taniuchi et al. | 347/103 |
| 2005/0129859 | A1 | 6/2005 | Misev et al. | |
| 2006/0144287 | A1 * | 7/2006 | Tsubaki et al. | 106/31.13 |
| 2008/0032072 | A1 | 2/2008 | Taniuchi et al. | 428/32.11 |

FOREIGN PATENT DOCUMENTS

| | | | |
|---|---|---|---|
| JP | 2916864 | | 4/1999 |
| JP | 2002-321350 | | 11/2002 |
| JP | 2004-42454 | | 2/2004 |
| JP | 2004-50449 | | 2/2004 |
| JP | 2004050449 | * | 2/2004 |
| WO | 2004/113082 | A1 | 12/2004 |
| WO | WO 2004/113082 | * | 12/2004 |

OTHER PUBLICATIONS

Mar. 11, 2010 Chinese Official Action in Chinese Patent Application No. 200780013745.X (with translation).

PCT International Search Report in Application No. PCT/JP2007/062548.

* cited by examiner

METHOD FOR PRODUCING RECORD PRODUCT, AND INTERMEDIATE TRANSFER BODY AND IMAGE RECORDING APPARATUS USED THEREFOR

TECHNICAL FIELD

The present invention relate to a method for producing a record product, and an intermediate transfer body and an image recording apparatus used therefor.

BACKGROUND ART

An ink jet recording method is a system wherein liquid ink is directly ejected to a recording medium such as paper, plastic sheet or others to record a letter or an image. This method is advantageous in apparatus used therefor in that it is easily adaptable for the color printing and capable of being smaller in size since the mechanism is simple, or low in noise. Also, since this system uses no form plate, it is possible to readily obtain a stable print from the beginning. Further, the recent ink jet printer can output an image having a high quality grade equal to that of silver salt photograph at a high speed, whereby it has widely been used in homes or offices.

One of the problems of the ink jet recording system is in that the quality grade of the image is different between used recording media. This is because the fixing of the ink is relied upon the permeation thereof to the recording medium. Recently, the demand has been increased particularly in the industrial field in that high-grade images are output irrespective of kinds of a recording medium, and becomes a serious problem in the ink jet recording system.

For instance, in the recording medium having the excessively high ink permeability, a phenomenon called as feathering may occur wherein ink blurs along fibers of paper. Also, there may be an inconvenience in that colorant sinks together with water in the ink whereby the color development becomes worse or an image formed on a front surface is visible from a rear surface. If the ink-permeability of the recording medium is less, there may be a phenomenon called as beading wherein adjacent ink dots are attracted together, that called as bleeding wherein inks are mixed together in a boundary between different color areas or a case wherein printed ink does not dry for a long time. These problems are caused by a high fluidity of ink used for the ink jet recording system.

An ink ejection system in the ink jet recording system includes, other than a continuous system, an on-demand system using an electro-thermal transducer element (heating element) or an electro-mechanic transducer element. In either system, it is impossible to eject ink other than that having a low viscosity. This is because ink used in the ink jet recording system must have high fluidity within the ink jet head for satisfying the ejection suitability. On the contrary, as described before, the ink is required for having low fluidity on the surface of the recording medium so that the adjacent ink drops are not mixed together or attracted to each other. As mentioned above, in the ink jet recording system, in spite of ejecting ink having high fluidity to the recording medium, the fluidity thereof must be lowered on the recording medium; in other words, opposite characteristics are required.

To simultaneously satisfy such requisites opposed to each other, it has been proposed that an ink image is formed on an intermediate transfer body, and transferred to a desired recording medium to record the ink image thereon (see the United States Patent Nos. 4,538,156 and 5,099,256 and Japanese Patent Laid-Open No. 62-92849(1987)). In these systems, the ink ejected from the ink-jet head is once adhered to the transfer body so that an ink image wherein the fluidity of the ink is lowered to some extent is formed on the transfer body, which image is then transferred from the transfer body to the recording medium.

In this method, however, while it is premised on the assumption in that the ink image having no disturbance is formed on the surface of the intermediate transfer body, the surface of the intermediate transfer body used therefor is not ink-absorbable in view of the cleanability by taking the repeated uses into account and/or the transferring ability to the recording medium. Accordingly, the beading and/or the bleeding are liable to occur on the surface of the intermediate transfer body.

In Japanese Patent Publication No. 2916864 and Japanese Patent Laid-Open No. 2002-321350, a method has been proposed wherein liquid reactive to ink is coated on the intermediate transfer body, so that when the ink is in contact with this liquid, the two liquids are reacted to control the ink fluidity. It is said that if this method is adopted, the beading and/or the bleeding are prevented from occurring on the surface of the intermediate transfer body, whereby a favorable image is obtainable.

In this case, however, since ink drops are applied to the intermediate transfer body via a layer of the reactive liquid, the image quality is largely influenced by a state of the reactive liquid applied to the transfer body. That is, if the reactive liquid is not properly applied to the intermediate transfer body to form a thin layer having a uniform thickness, the landing deviation of ink drop or the deformation of dot shape may occur to disturb the formation of a high grade image on the intermediate transfer body and thus the recording of a high quality image on the recording medium.

DISCLOSURE OF THE INVENTION

An object of the present invention is to decrease the landing deviation of ink drop or the deformation of dot shape in the image recording system of an intermediate transfer type using the ink jet recording method, by properly forming a reactive liquid layer on the intermediate transfer body. The present invention is capable of forming a high grade image on the intermediate transfer body and thus recording a high quality image on the recording medium.

In a first aspect of the present invention, there is provided a method for producing a record product as a recording medium on which an ink image is formed, comprising the steps of: applying reactive liquid reactable with ink onto an intermediate transfer body having a pattern consisting of lyophilic sections and lyophobic sections at a surface thereof; forming an ink image on the intermediate transfer body by ejecting the ink from an ink jet head to the intermediate transfer body applied with the reactive liquid; and transferring the ink image formed on the intermediate transfer body to a recording medium.

In a second aspect of the present invention, there is provided an intermediate transfer body applied for the above producing method.

In a third aspect of the present invention, there is provided a method for producing a record product as a recording medium on which an ink image is formed, comprising the steps of: applying reactive liquid reactable with ink onto an intermediate transfer body having a pattern consisting of lyophilic sections and lyophobic sections at a surface thereof; forming an ink image on the intermediate transfer body by ejecting the ink from an ink jet head to the intermediate transfer body where the applied the reactive liquid exists on the lyophilic section; and transferring the ink image formed on the intermediate transfer body to a recording medium, wherein a dot of the reactive liquid is smaller than an ink dot for forming the ink image.

In a fourth aspect of the present invention, there is provided an image recording apparatus comprising: an intermediate transfer body having a pattern consisting of lyophilic sections and lyophobic sections at a surface thereof; applying device that applies reactive liquid reactable with ink onto the intermediate transfer body, an ink jet head that ejects ink to the intermediate transfer body applied with the reactive liquid, and a transfer section that transfers the ink ejected to the intermediate transfer body to a recording medium.

Effect of the Invention

According to the present invention, it is possible to form the ink image wherein the landing deviation of ink drop or the deformation of dot shape is decreased on the intermediate transfer body. And, by transferring the ink image thus formed, it is possible to record a high-quality image on various kinds of recording media in a stable manner.

Further features of the present invention will become apparent from the following description of exemplary embodiments (with reference to the attached drawings).

BEST MODE FOR CARRYING OUT THE INVENTION

1. Embodiment of Image Recording Device

Figure 1:
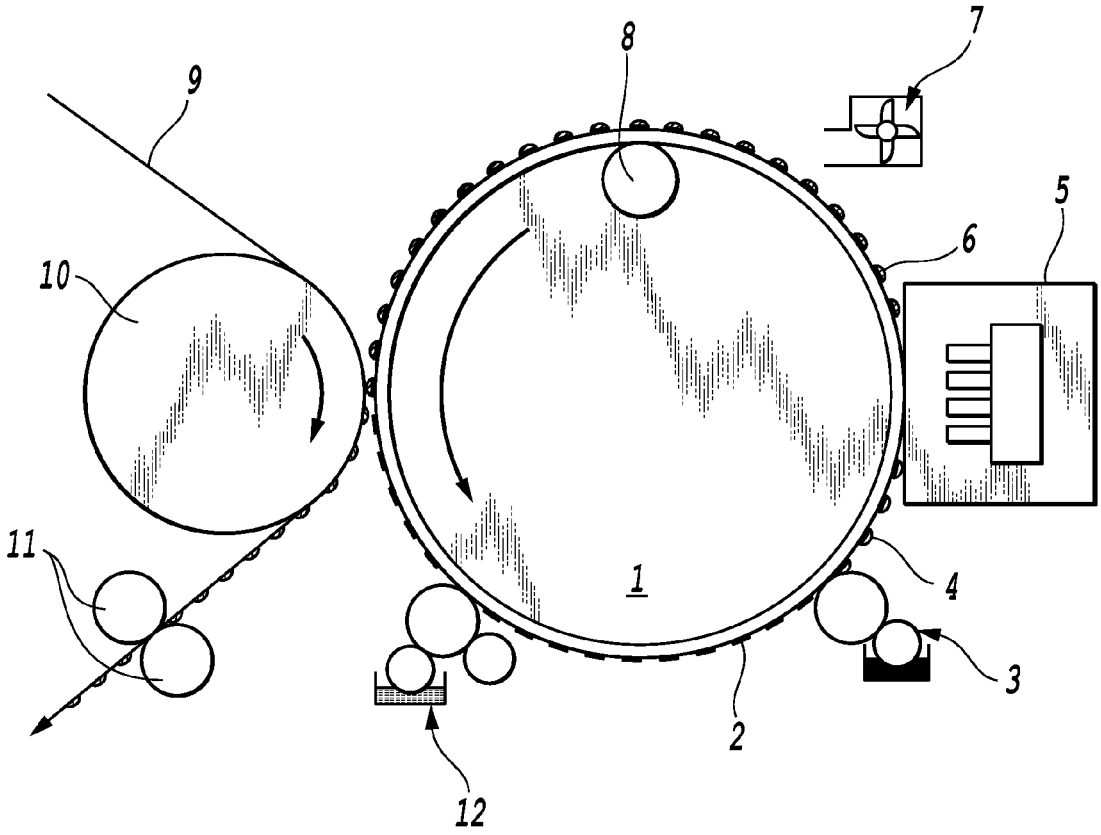
FIG. 1 is a schematic illustration of an image recording apparatus according to one embodiment of the present invention.

FIG. 1 illustrates a schematic view of an image recording apparatus according to one embodiment of the present invention. The image recording apparatus of this embodiment carries out a recording operation basically including a process for forming an ink image on an intermediate transfer body and a process for transferring the ink image formed on the transfer body to a desired recording medium.

In FIG. 1, reference numeral 1 denotes a cylindrical intermediate transfer body having a surface layer 2 on which pattern formed of lyophilic sections and lyophobic sections and driven to rotate about an axis 1A in the direction F shown by an arrow. At positions opposed to the outer circumference of the intermediate transfer body 1; i.e., the surface layer 2; there are an application device 3 for applying aqueous reactive liquid 4, an ink jet head 5 for ejecting ink to form an ink image on the intermediate transfer body and a pressure roller 10 for transferring the ink image to a recording medium 9.

That is, the intermediate transfer body 1 rotates in the direction shown by an arrow in the drawing, and is first applied with the reactive liquid 4 by the application device 3. Here, since the reactive liquid is of an aqueous type, the applied reactive liquid is hold on lyophilic sections. Accordingly, a constant amount of reactive liquid can always uniformly exist on the surface of the intermediate transfer body. Then, ink is ejected as droplets from the ink jet head 5 to form an ink image (mirror-reversed image) 6 on the surface layer 2 of the intermediate transfer body 1. Since the ink instantly agglomerates at that time due to the contact with the reactive liquid to lower the fluidity of colorant, there is no disturbance in the ink image. Then, a surface of the recording medium 9 to be recorded is brought into contact with the image formed on the intermediate transfer body 1, and pressed by the pressure roller 10 from a rear surface side, whereby the image is transferred to the recording medium 9.

In the device shown in FIG. 1, a water removal facilitating device 7 of a blower type is provided for the purpose of evaporating water or solvent component in the ink forming the image on the intermediate transfer body 1. Thereby, prior to the transfer, an amount of water or solvent component of the ink is decreased to an allowable limit of the recording medium. In this regard, according to the apparatus shown in FIG. 1, a heat roller 10 is used together with the former, in contact with the rear side of the intermediate transfer body 1 to heat the same. All thereof are not necessarily used but either one may be used.

Further, in the apparatus shown in FIG. 1, the intermediate transfer body is rinsed by a cleaning unit 12 on a subsequent stage for the preparation of receiving the next image, in order to use the intermediate transfer body a plurality of times after the ink image has been transferred to the recording medium 9.

When the ink jet recording is carried out after the reactive liquid is applied to the intermediate transfer body, a state of the reactive liquid on the intermediate transfer body is largely influenced on the final quality of the image. The important properties are a layer thickness of the reactive liquid and the uniformity thereof.

Figure 2A:
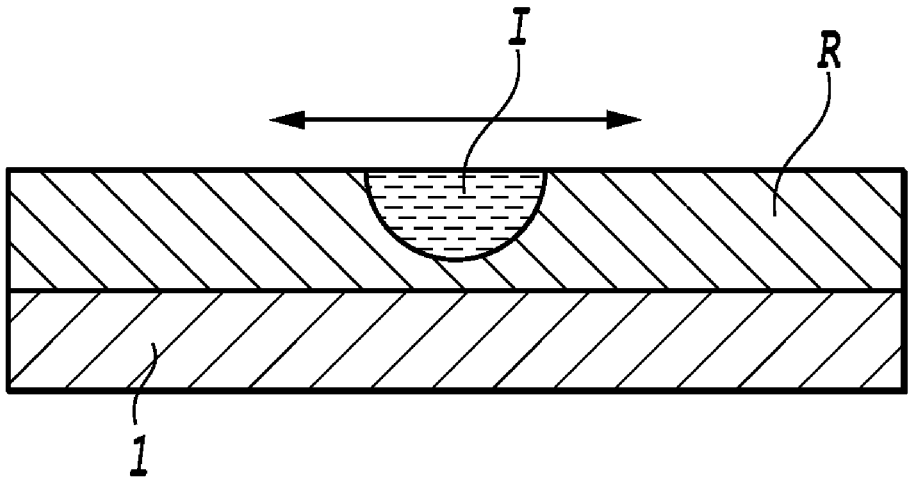
FIGS. 2A and 2B illustrate the importance of a state of reactive liquid applied to an intermediate transfer body, respectively.
Figure 2B:
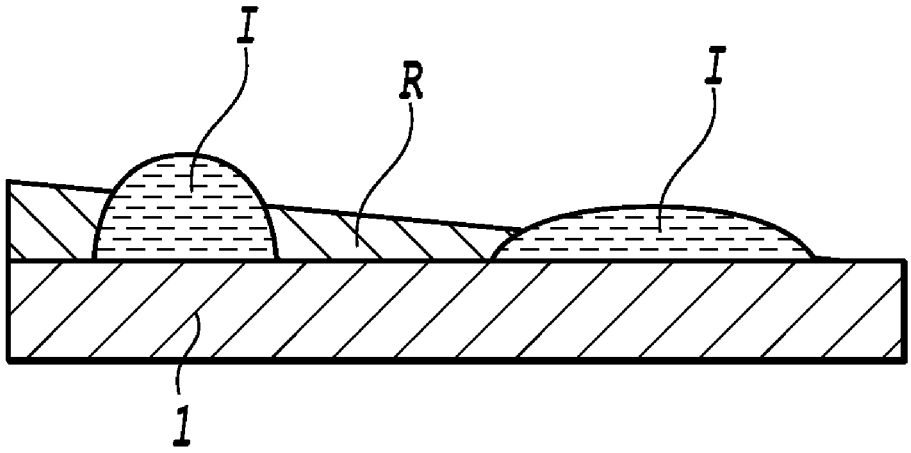

The explanation thereof will be made with reference to FIGS. 2A and 2B. The ink instantaneously reacts with the reactive liquid on the intermediate transfer body when being in contact with the latter, to lower the fluidity. If the layer thickness of the reactive liquid is too thick, a layer of the reactive liquid R having the fluidity remains between the ink agglomerate I generated by the reaction and the intermediate transfer body 1. In this state, the ink agglomerate I is easily movable due to a shock caused by a landing of the ink droplet or the movement of the intermediate transfer body. Also, if an amount of the applied reactive liquid R; i.e., a layer thickness of the reactive liquid; is uneven, a dot diameter of the ink agglomerate I becomes irregular due to the influence of the reaction power or others, or the positional deviation of dot or the deformation of dot shape may be caused by the variation of landing resistance of the ink droplet. That is, as shown in FIG. 2B, there is a tendency in a portion having a larger layer thickness of the reactive liquid in that the reaction strongly occurs to instantaneously lower the fluidity of ink, while, on the other hand, in a portion having a smaller layer thickness of the reactive liquid, the reaction weakly occurs to widely flatten the ink dot.

Generally, while it is thought that the surface of the intermediate transfer body is desirably maintained in a hydrophilic state (a state easily wettable with reactive liquid) for applying the reactive liquid to the intermediate transferbody to form a thin and uniform layer, such a state is still insufficient. If the whole surface of the intermediate transfer body has a high wettability, the reactive liquid is easily movable and liable to be nonuniformly distributed. Such the movement or nonuniform distribution causes the disturbance of the ink image on the intermediate transfer body. In addition, since all amount of the supplied reactive liquid is received if the whole surface of the intermediate transfer body is lyophilic, the applied amount thereof is relied on the accuracy of the application device, which means that a complicated and expensive application device is necessary for controlling the same at a high accuracy.

Figure 18:
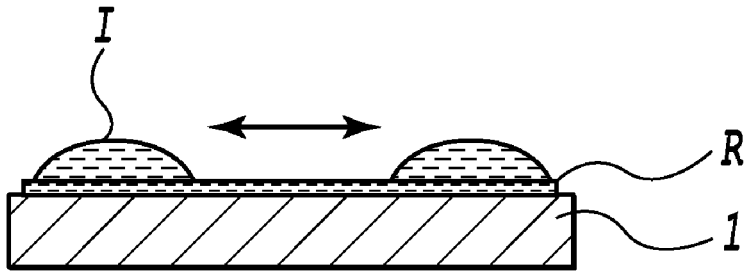
FIG. 18 illustrate an atate where an ink moves on a thin layer of reactive liquid.

Also, if the reactive liquid is applied to the intermediate transfer body, all over the surface of which is treated to be lyophilic, the applied reactive liquid uniformly spreads over the surface of the transfer body to a relatively wide range to form a layer of the reactive liquid R having a relatively wide area (see FIG. 18). However, if ink I is applied onto the reactive liquid in such a state, the ink I moves on the reactive liquid to a relatively wide extent. That is, since the layer surface of the reactive liquid is a free surface allowing the ink to be freely movable, if the laer has a relatively wide area, the ink is movable in a relatively wide range. Accordingly, to mitigate the disturbance of the ink image caused by the movement of the ink, it is necessary to limit the moving range of the ink on the reactive liquid to a certain extent.

According to this embodiment, as described in detail below, the surface of the intermediate transfer body is made to be lyophilic in accordance with a proper fine pattern so that an amount of reactive liquid held on the respective part of the pattern is constant. As a result, a layer of the reactive liquid having a uniform and proper thickness is obtainable. Also, by forming the lyophilic section solely in part of the surface of the transfer body, not overall thereof, the range wherein the reactive liquid exists is limited (see FIG. 19) so that the ink does not unnecessarily move on the reactive liquid (see FIG. 20).

2. Processes of the Inventive Method and Elements Applicable Thereto

Next, processes according to the method of the present invention and elements applicable thereto will be described in detail. The description will be done suitably in relation to the device assembly shown in FIG. 1.

The apparatus shown in FIG. 1 carries out a process (a) for applying reactive liquid onto the intermediate transfer body having the surface layer 2 on which is formed a pattern consisting of lyophilic sections and lyophobic sections, a process (b) for forming an ink image by an ink jet head, and a process (c) for transferring the ink image to a recording medium. Thereby a recorded product comprising the recording medium having the ink image is produced.

2.1 Process (a): Process for Applying Reactive Liquid onto the Intermediate Transfer Body

Intermediate Transfer Body

The intermediate transfer body or a support of the surface thereof may be any of those at least capable of bringing the surface into line-contact with a recording medium. That is, it may be of a roller type as described above or of a belt type or a sheet type in accordance with configurations of an image-forming device to be applied or aspects of the image transfer to the recording medium. The surface 2 may be made of suitable elastic material such as rubber or plastics. It is effective to use material having a hardness in a range from 10 to 100° measured by type A durometer (according to JIS K6253), and further, if the material has the hardness in a range from 40 to 80°, the surface is applicable to almost all recording media.

Design of Lyophilic/Lyophobic Sections

Regarding the degree of lyophilic or lyophobic properties in the pattern on the surface of the intermediate transfer body is preferably optimized in accordance with reactive liquids to be used. It is important that the reactive liquid used is not held on the lyophobic section but is held solely on the lyophilic section. The application range may change in accordance with surface tensions or viscosities of the reactive liquid used, kinds of liquid-application means, liquid-application rates and pattern configurations. Generally, a contact angle of such a section with the reactive liquid is 60° or less in the lyophilic section and 60° or more in the lyophobic section, preferably 20° or less in the lyophilic section and 80° or more in the lyophobic section.

As described above, it is preferable that the reactive liquid exists solely on the lyophilic section. However, there is no problem even if a small amount of reactive liquid exists adhered on the lyophobic section. Namely, since the effect of the present invention is obtainable if an amount of the reactive liquid which exists on the lyophobic section is so small that it is not brought into contact with the reactive liquid which exists on the lyophilic sections adjacent, the existence of the reactive liquid on the lyophobic section is allowable. Accordingly, the present invention includes aspects wherein a small amount of the reactive liquid exists on the lyophobic section other than those wherein the reactive liquid does not at all exist on the lyophobic section.

The pattern consisting of the lyophilic sections and the lyophobic sections is provided for controlling the application state of the reactive liquid, wherein a shape, a width and a pitch of an element of the lyophilic section are important.

Several patterns of the lyophilic section applicable to the present invention will be explained with reference to FIGS. 3A to 3F, FIGS. 4A to 4E, FIGS. 5A to 5D and FIGS. 6A and 6B. In these drawings, parts coated with black color indicate elements of the lyophilic section, a hatched part indicates an ink dot, and parts other than above indicate elements of the lyophobic section.

Shapes of the elements of the lyophilic section are not limited to those disclosed above provided they satisfy the above-mentioned conditions.

Figure 3A:
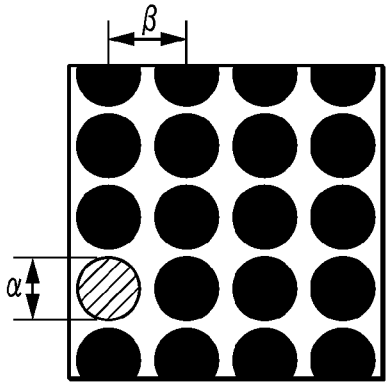
FIGS. 3A to 3F illustrate various examples of a lyophilic/lyophobic pattern formed on the intermediate transfer body, wherein the lyophilic pattern is formed of isolated (scattered) lyophilic elements.
Figure 3B:
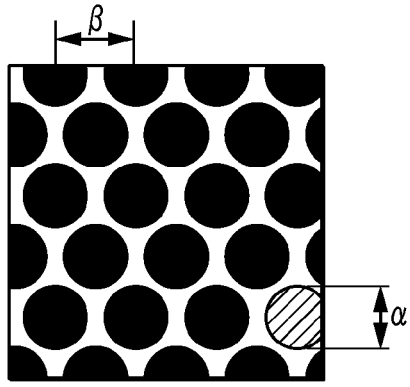
Figure 3C:
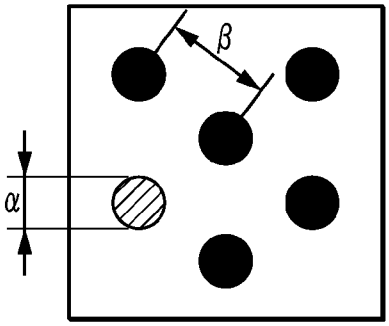
Figure 3D:
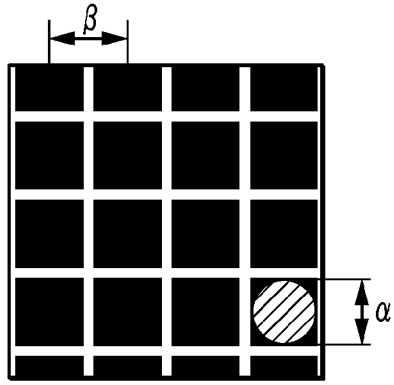
Figure 3E:
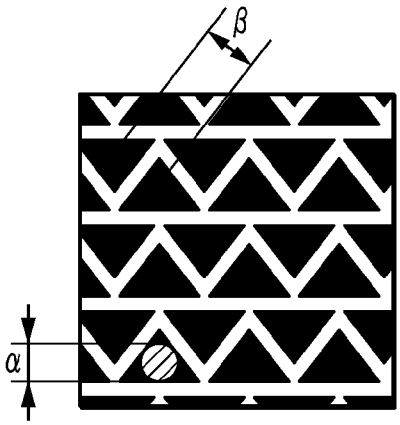
Figure 3F:
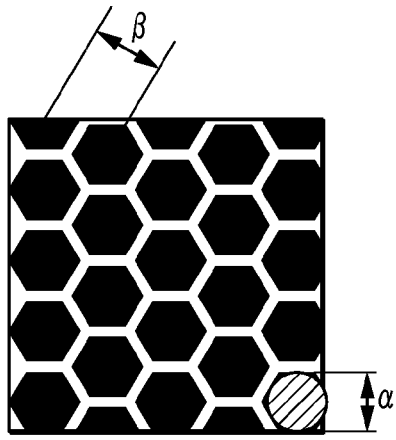

FIGS. 3A to 3F illustrate examples in each of which the lyophilic pattern is constituted by a plurality of isolated (scattered) lyophilic elements. Here, in FIG. 3A, the elements in the lyophilic section are circles, each having a diameter of $\alpha$, arranged in the two-dimensional directions. In FIG. 3B, the circular lyophilic elements are arranged in a zigzag manner. In FIG. 3C, a distance (pitch) $\beta$ between the centers of the adjacent lyophilic elements is larger than that in FIG. 3B. In FIG. 3D, the lyophilic elements are squares, each having a side length of $\alpha$, arranged in the two-dimensional directions. Also, in FIGS. 3E and 3F, the shapes of the lyophilic elements are triangular and hexagonal, respectively.

Figure 4A:
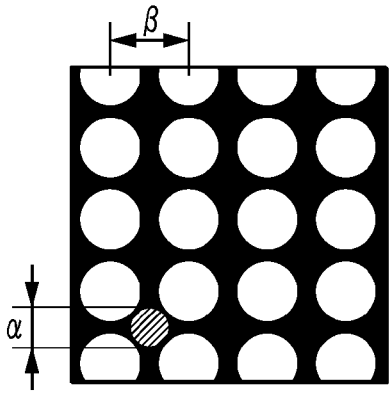
FIGS. 4A to 4E illustrate various examples of the lyophilic/lyophobic pattern formed on the intermediate transfer body, wherein the lyophilic pattern is formed of continuous elements of a lyophilic section.
Figure 4B:
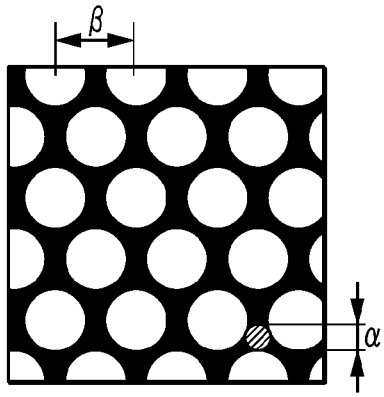
Figure 4C:
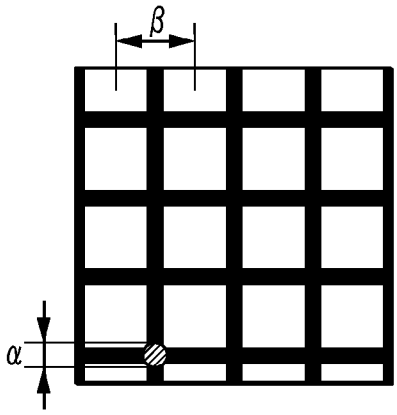
Figure 4D:
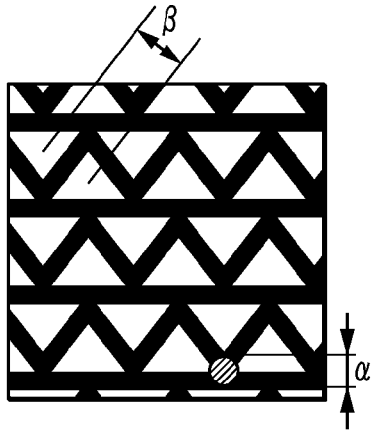
Figure 4E:
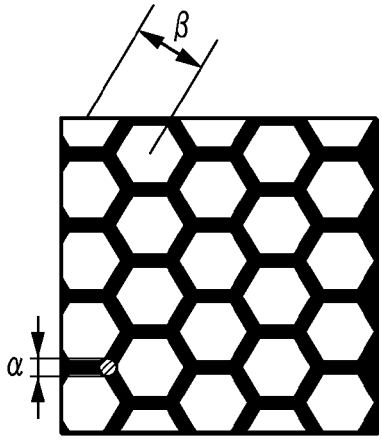
Figure 5A:
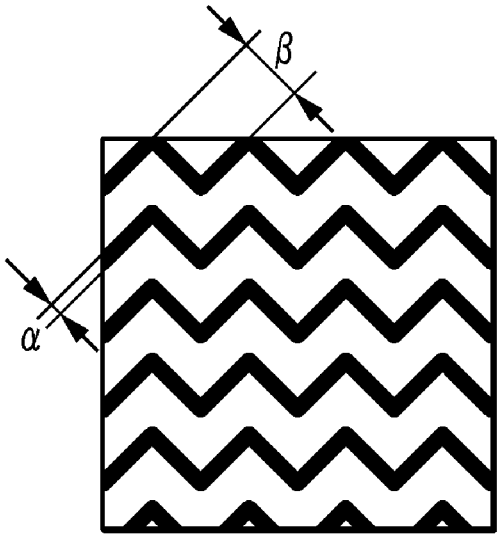
FIGS. 5A to 5D illustrate various examples of the lyophilic/lyophobic pattern formed on the intermediate transfer body, wherein both of lyophilic sections and lyophobic sections are formed of continuous elements.
Figure 5B:
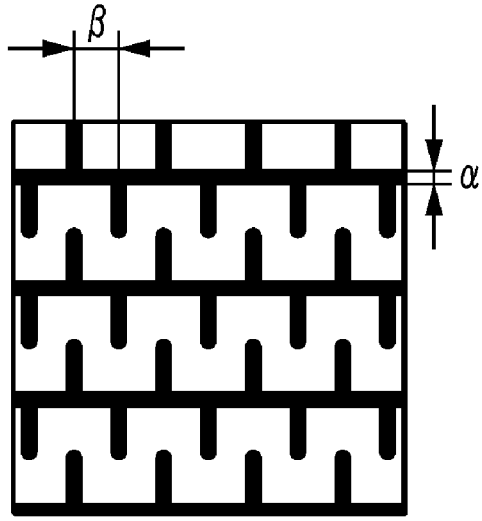
Figure 5C:
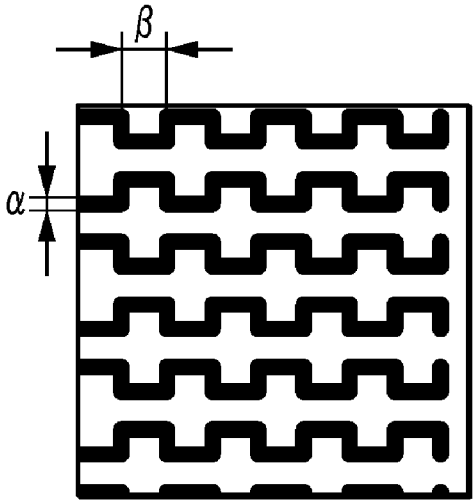
Figure 5D:
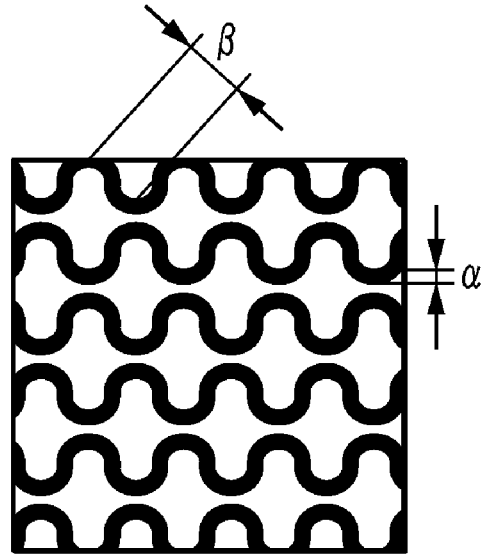

In each of FIGS. 4A to 4E, the lyophilic pattern is constituted by continuous lyophilic elements so that the lyophobic elements are isolated (scattered). Here, in FIG. 4A, circular lyophobic elements are arranged in the two-dimensional directions; and in FIG. 4B, the circular lyophobic elements are arranged in a zigzag manner. In FIG. 4C, square-shaped lyophobic elements are arranged in the two-dimensional directions. Also, in FIGS. 4D and 4E, triangular and hexagonal lyophobic elements are obtained, respectively. In these cases, a width $\alpha$ of the lyophilic element is equal to a shortest distance between the adjacent lyophobic elements.

FIGS. 5A to 5D illustrate various wave-shaped lyophilic elements wherein the lyophilic element and the lyophobic element are of a continuous shape, respectively.

Figure 6A:
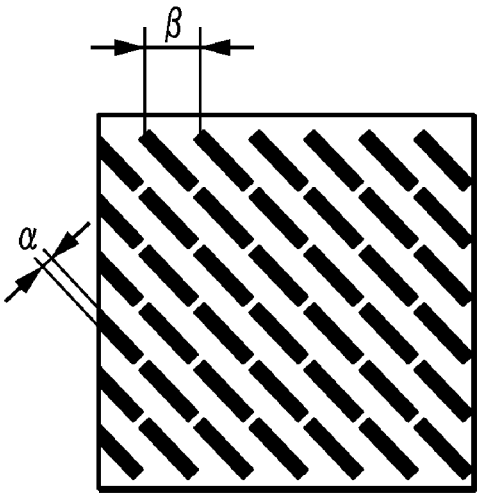
FIGS. 6A and 6B illustrate two examples of the lyophilic/lyophobic pattern other than above formed on the intermediate transfer body.
Figure 6B:
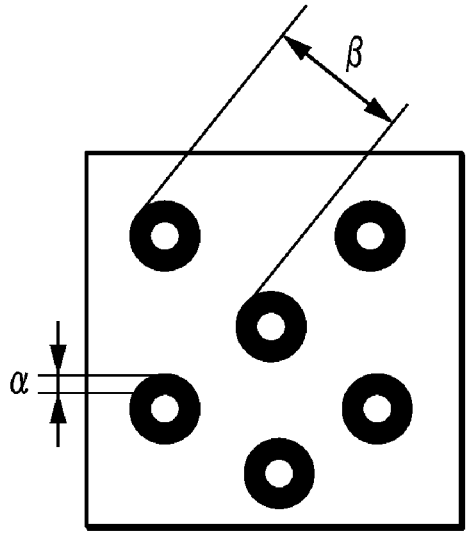

In this regard, these shapes of the lyophilic element and the lyophobic element are merely illustrative and other shapes such as shown in FIGS. 6A and 6B may be employed. Also, while those in which various shapes are mixed or a pitch of the pattern is not completely constant may be employed, it is more preferable that single-shaped elements are arranged at an equal pitch. While the embodiment shown in FIG. 1 is capable of ejecting a plurality of kinds of color ink onto a single intermediate transfer body, it is also possible to use patterns different from each other when a plurality of intermediate transfer bodies are used for forming a multi-color printing.

The width of the lyophilic element is a diameter of an imaginary circle inscribed in the lyophilic element (see $\alpha$ in FIGS. 3A to 6B). Since an ink droplet supplied from the ink jet head is spherical during the flight and becomes circular after the landing, the inscribed circle is adopted as a standard as described above. This standard is the same even if the element is either isolated or continuous. Even if areas of the lyophilic elements are the same to each other, it is possible to form a more uniform and thinner layer of the reactive liquid as the pattern width is smaller.

The pitch of the lyophilic element ($\beta$ in FIGS. 3A to 6B) corresponds to a repeated period in the isolated pattern elements, and to a distance between adjacent inflexion points in the continuous pattern element.

Figure 7A:
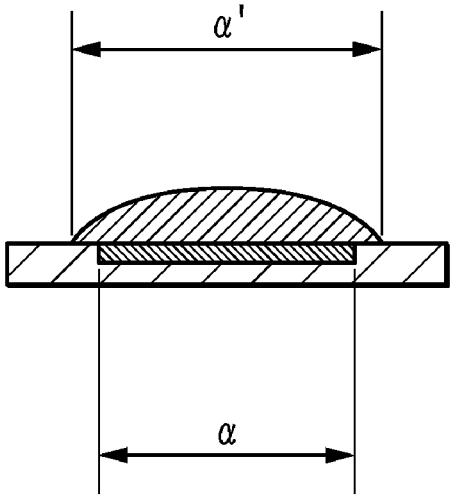
FIGS. 7A and 7B are illustrations for explaining the design condition of the lyophilic pattern formed on the intermediate transfer body.
Figure 7B:
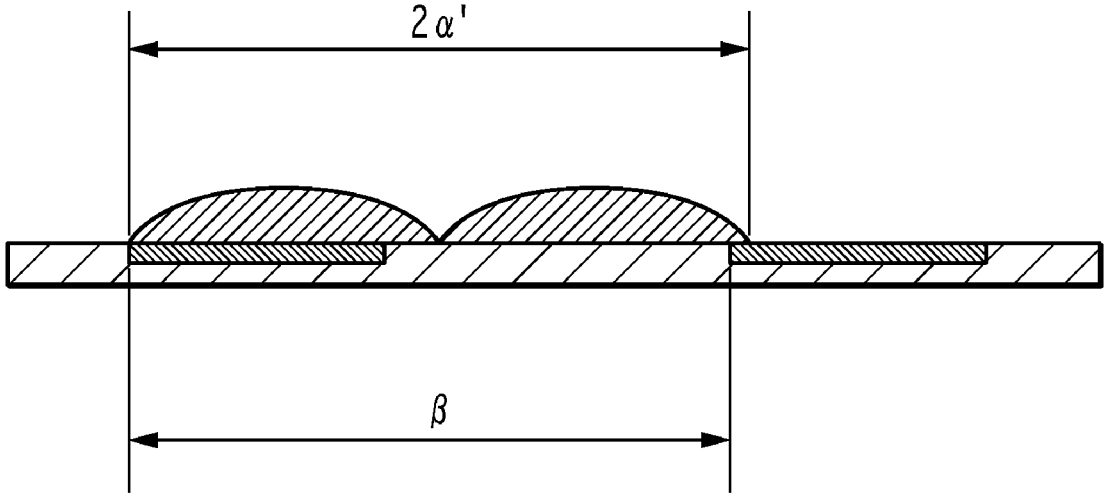
Figure 8A:
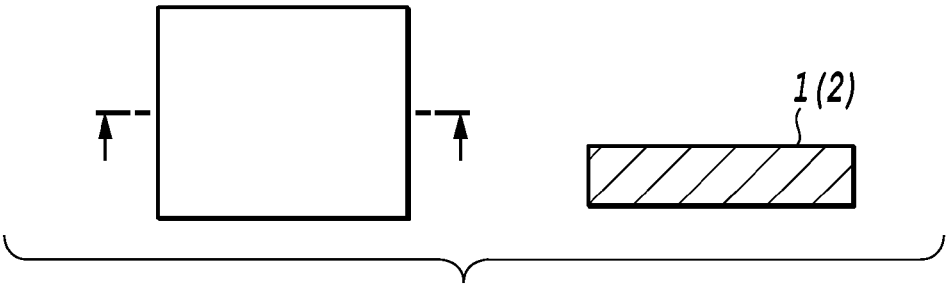
FIGS. 8A to 8D illustrate one example of a method for forming the lyophilic/lyophobic pattern on the intermediate transfer body.
Figure 8B:
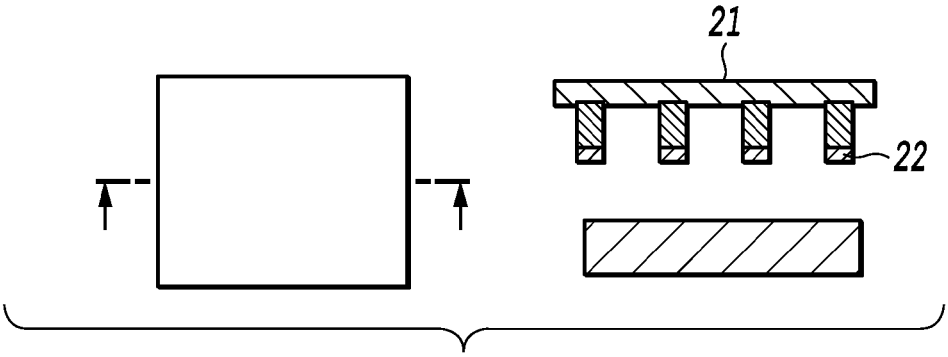
Figure 8C:
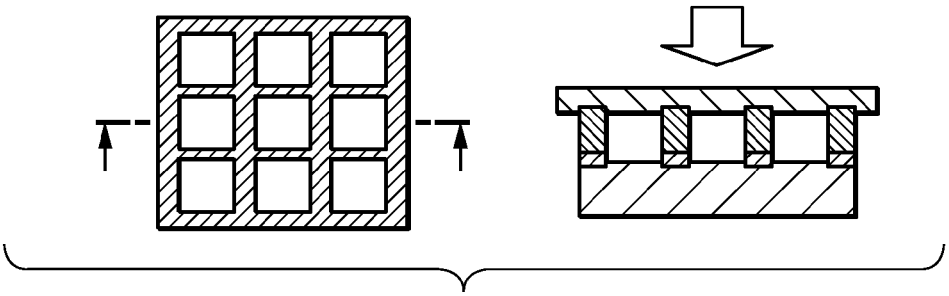
Figure 8D:
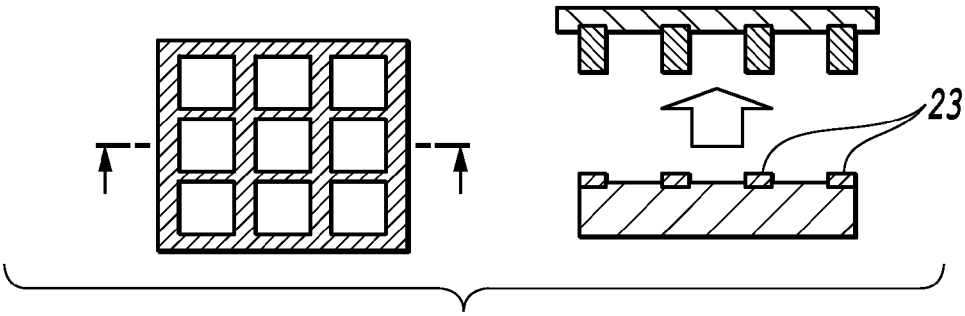
Figure 9A:
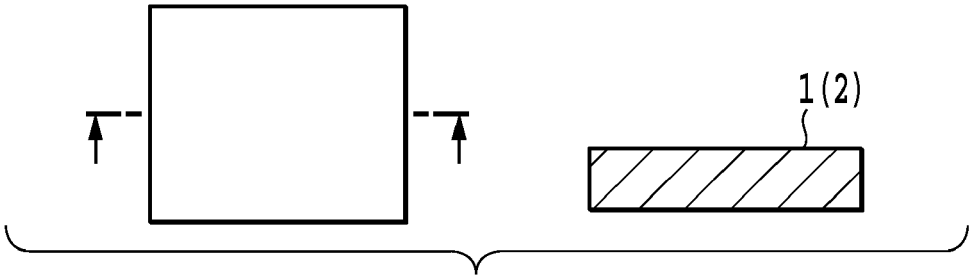
FIGS. 9A to 9D illustrate one example of a method for forming the lyophilic/lyophobic pattern on the intermediate transfer body.
Figure 9B:
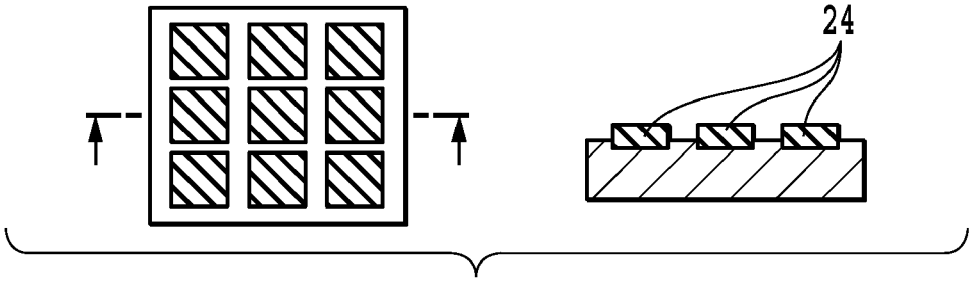
Figure 9C:
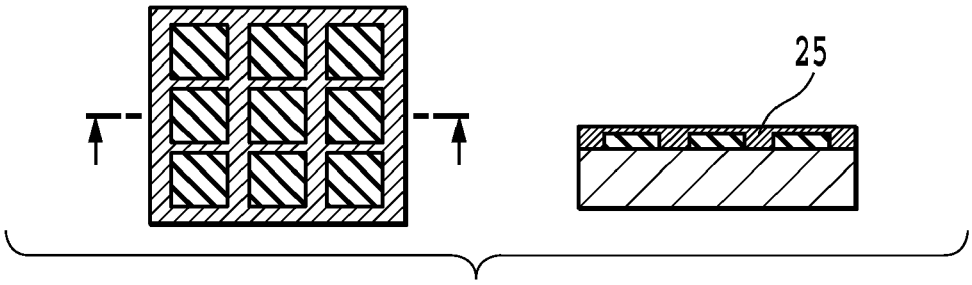
Figure 9D:
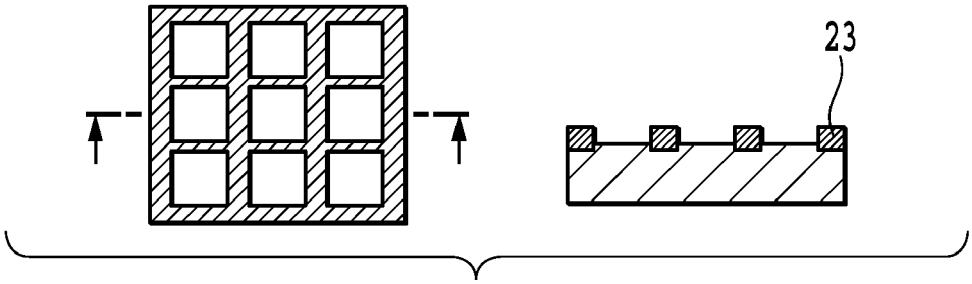
Figure 10A:
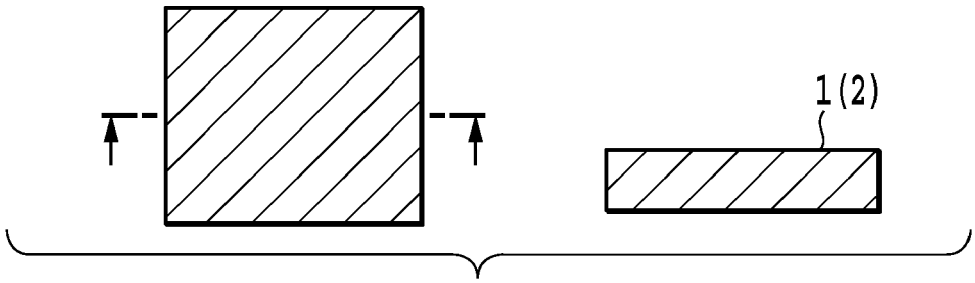
FIGS. 10A to 10D illustrate one example of a method for forming the lyophilic/lyophobic pattern on the intermediate transfer body.
Figure 10B:
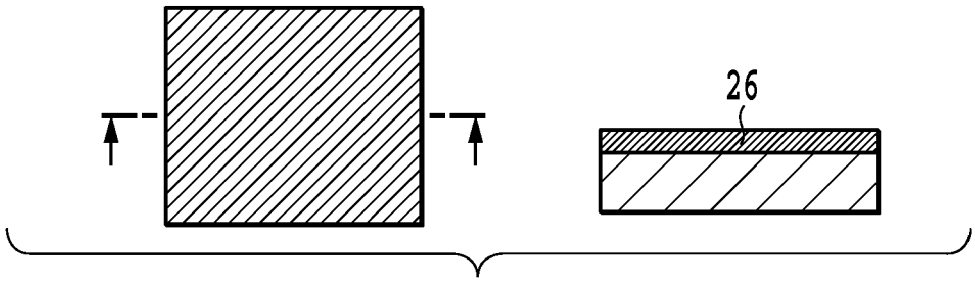
Figure 10C:
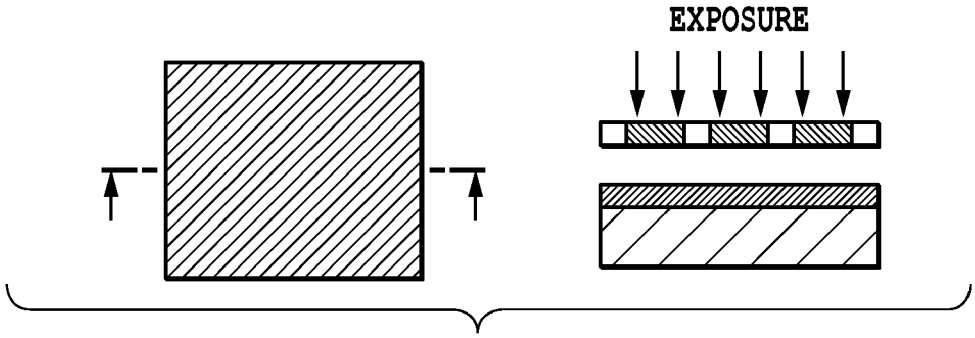
Figure 10D:
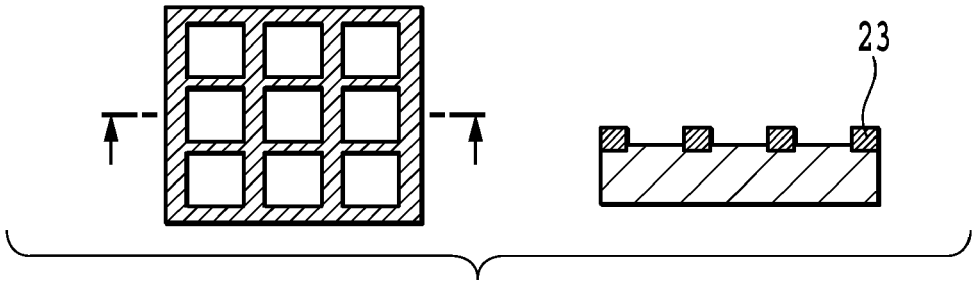
Figure 11A:
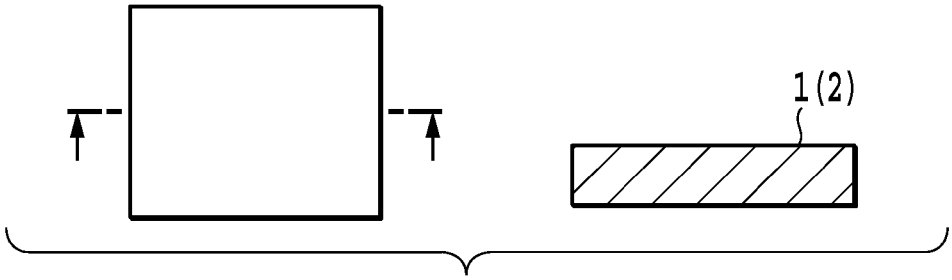
FIGS. 11A to 11D illustrate one example of a method for forming the lyophilic/lyophobic pattern on the intermediate transfer body.
Figure 11B:
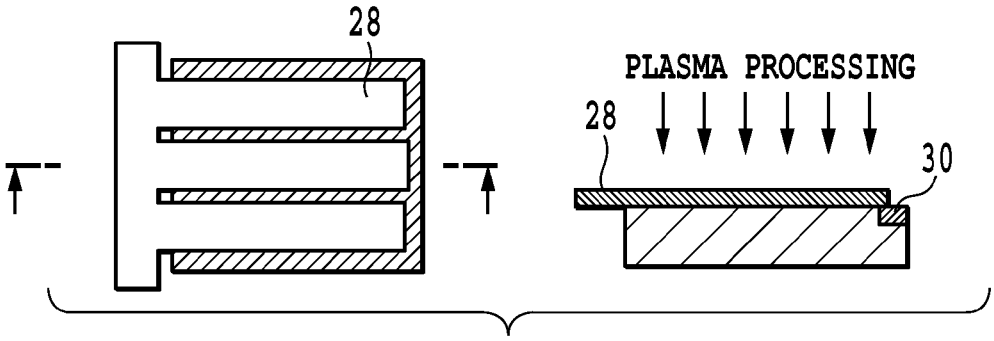
Figure 11C:
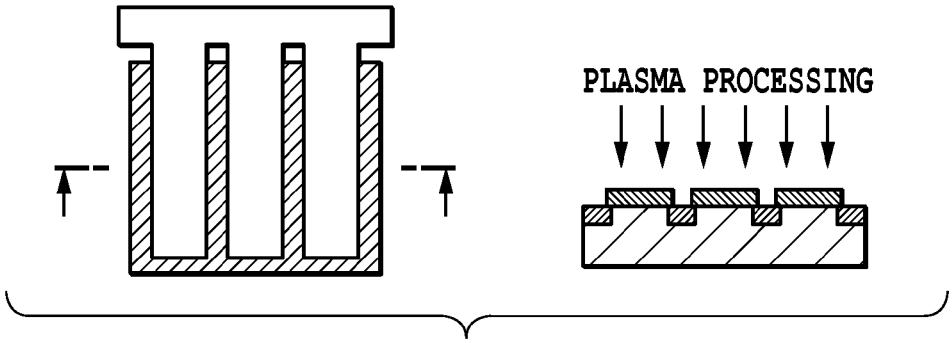
Figure 11D:
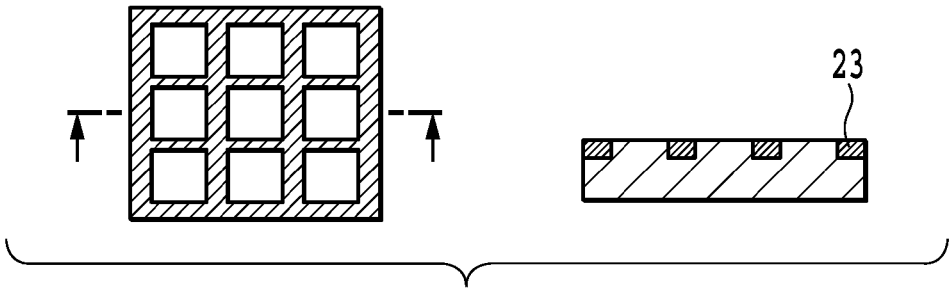
Figure 12A:
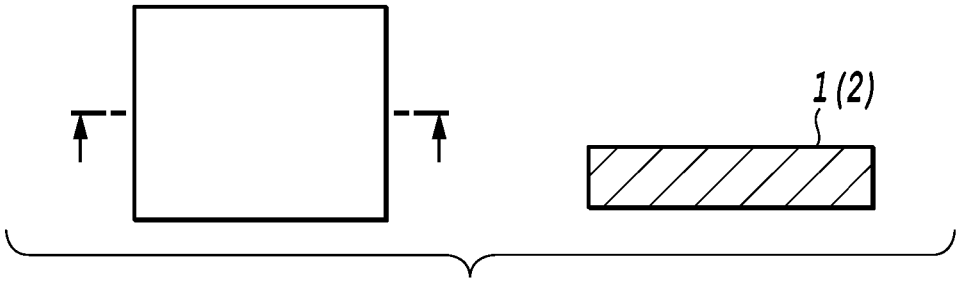
FIGS. 12A to 12D illustrate one example of a method for forming the lyophilic/lyophobic pattern on the intermediate transfer body.
Figure 12B:
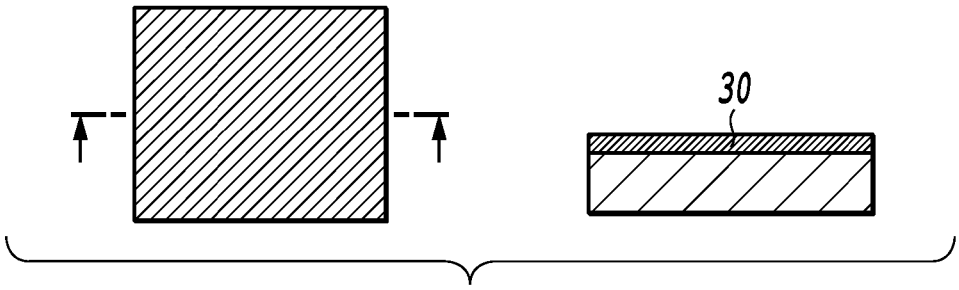
Figure 12C:
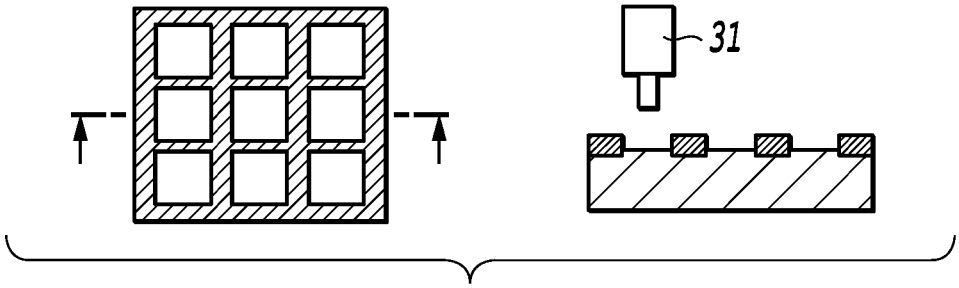
Figure 12D:
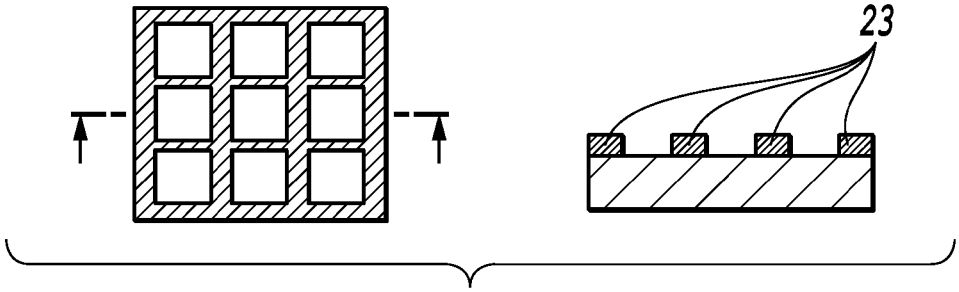
Figure 13A:
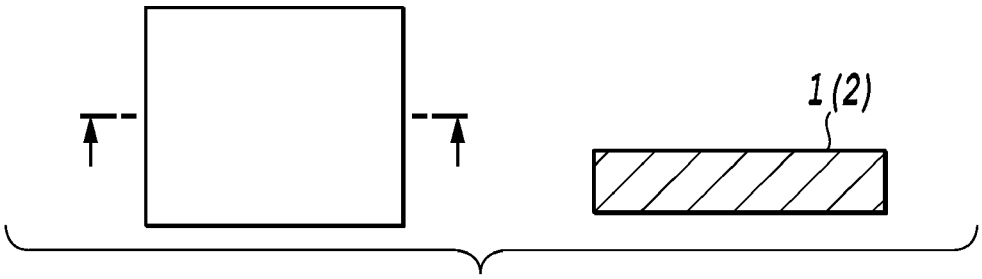
FIGS. 13A to 13D illustrate one example of a method for forming the lyophilic/lyophobic pattern on the intermediate transfer body.
Figure 13B:
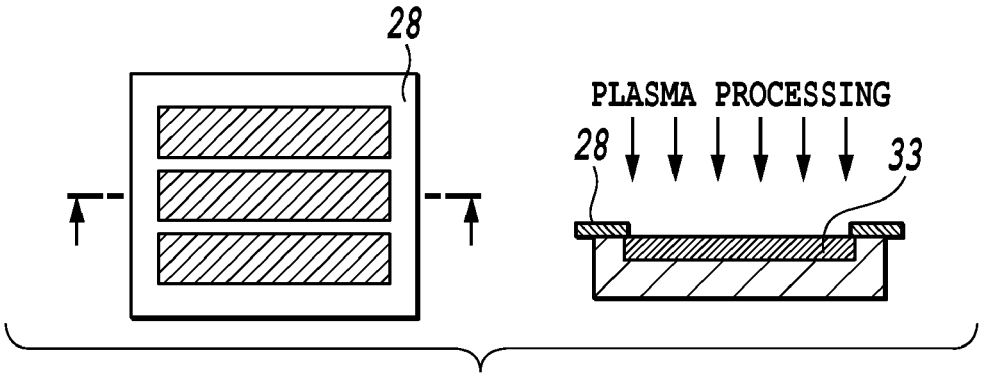
Figure 13C:
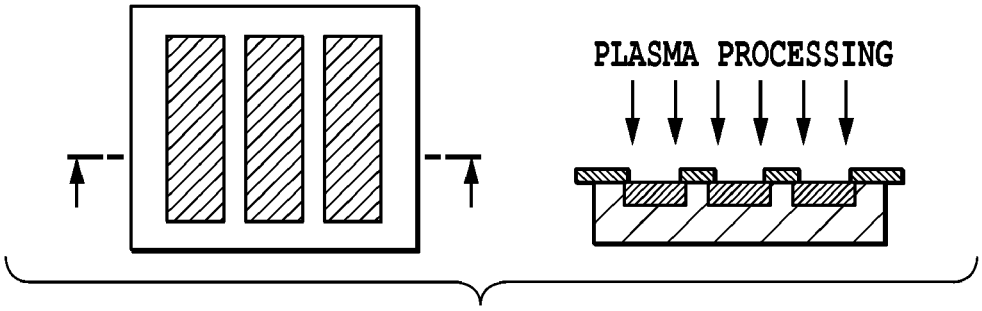
Figure 13D:
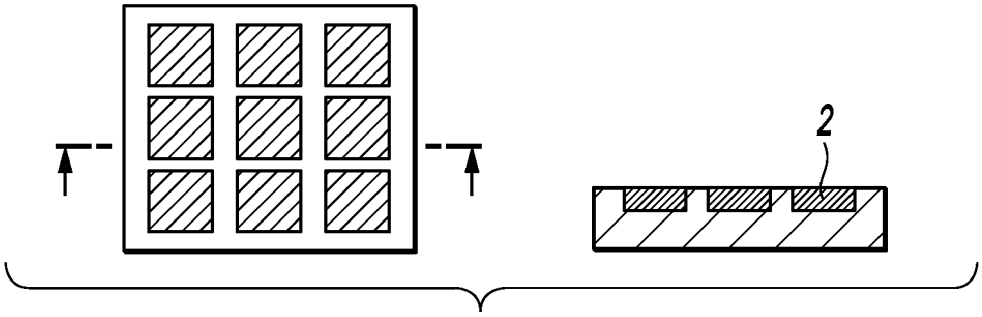
Figure 14A:
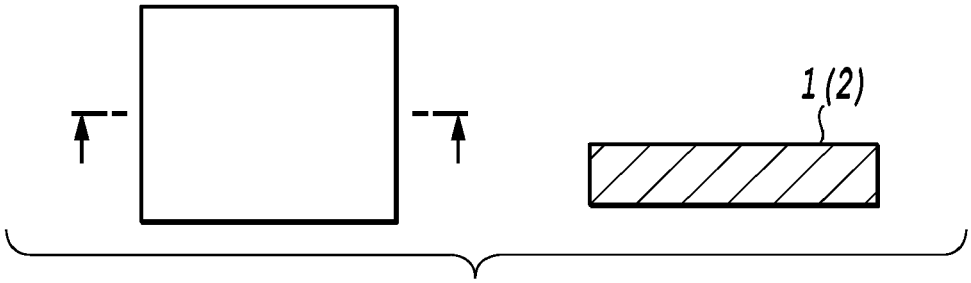
FIGS. 14A to 14D illustrate one example of a method for forming the lyophilic/lyophobic pattern on the intermediate transfer body.
Figure 14B:
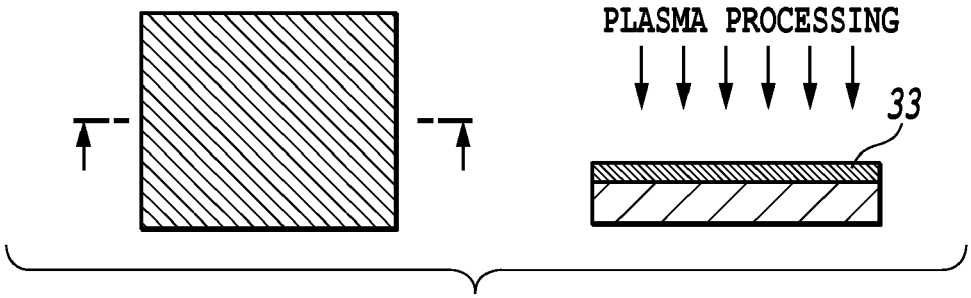
Figure 14C:
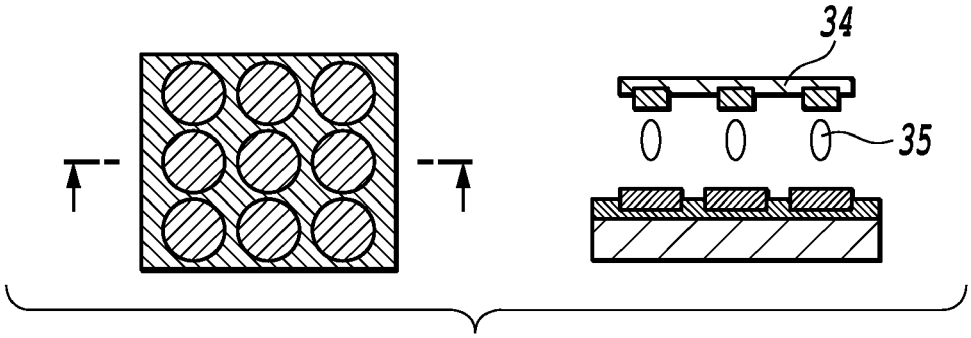
Figure 14D:
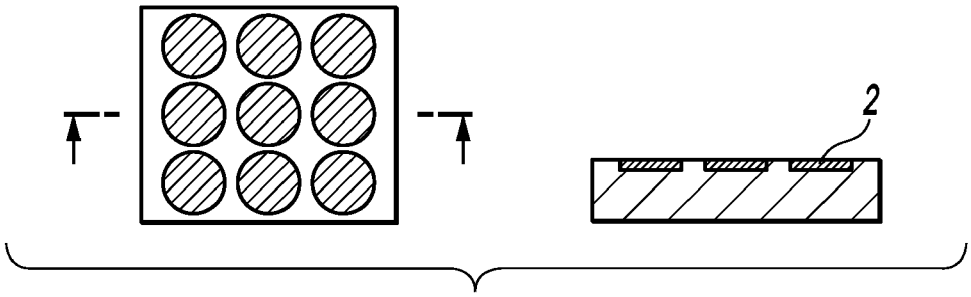

A procedure for favorably selecting the width $\alpha$ and the pitch $\beta$ of the lyophilic section will be explained with reference to FIGS. 7A and 7B.

The dimensional standard of the lyophilic/lyophobic element is a maximally enlarged diameter $\alpha'$ of the ink droplet on the intermediate transfer body. Generally, if the ink droplet lands the intermediate transfer body, the dot diameter becomes larger due to the kinetic energy thereof. When all the kinetic energy has been consumed, the maximally enlarged diameter $\alpha'$ is attained, and then the dot diameter becomes shorter if the surface of the intermediate transfer body is lyophobic, whereby a diameter of the ink droplet in a stationary state is smaller than $\alpha'$.

In this embodiment, it is a premise that the ink is in contact with the reactive liquid which exists on the lyophilic section, and a maximum pitch $\beta$ of the reactive liquid necessary for the contact of the reactive liquid on the lyophilic section with ink droplet is $2\times\alpha'$ ($2\alpha'=\beta$). Note, in this case, since the ink droplet does not meet the inflexion point if the landing point of the ink droplet is away from a designed position, it is more preferable that the maximum pitch $\beta$ is selected to be $2\times\alpha'$ or less ($2\alpha'\geqq\beta$) so that the reactive liquid is assuredly in contact with the ink.

On the other hand, if the width of the lyophilic element exceeds the maximally enlarged diameter $\alpha'$, the position of the ink droplet cannot be restricted by the reactive liquid which exists on the element of the lyophilic section. Accordingly, the maximum width of the element in the lyophilic section is selected to be equal to $\alpha(\alpha\leqq\alpha')$. Since the layer thickness of the reactive liquid is proportional to the width of the element in the lyophilic section, the width $\alpha$ of the element in the lyophilic section is preferably $\frac{1}{2}\alpha'$ or less in view of obtaining a favorable layer thickness of the reactive liquid.

In this regard, while the predetermined effect is obtainable if either one of the pitch or width of the element in the lyophilic liquid section is selected to satisfy the above-mentioned conditions, it is more desirable to design that both the conditions are satisfied.

Formation of Lyophilic/Lyophobic Section Pattern

When the pattern consisting of the lyophilic and lyophobic sections is formed on the intermediate transfer body, various methods can be proposed.

Some of subsequent processes for forming a pattern will be described with reference to FIGS. 8A to 8D to FIGS. 15A to 15D. In each of these drawings, a left side depicts a schematic plan view and a right side depicts a schematic cross-sectional view.

FIGS. 8A to 8D illustrate a process for forming lyophobic sections 23 by bringing a printing plate 21 carrying lyophobic material into contact with a substrate of the intermediate transfer body 1 or a substrate of the surface layer thereof formed of lyophilic material.

FIGS. 9A to 9D illustrate a process employing a lift-off method wherein a resist pattern 24 is formed on a substrate of the intermediate transfer body 1 or a substrate of the surface layer 2 thereof exhibiting the lyophilic property by a photolithographic method, and after lyophobic material 25 is applied thereon, the resist pattern is removed.

FIGS. 10A to 10D illustrate a process wherein lyophobic resist 26 is applied on a substrate of the intermediate transfer body 1 or the surface layer 2 thereof exhibiting the lyophilic property and patterned by the exposure to form lyophobic sections 23.

In FIGS. 11A to 11D, a mask 28 is disposed on a substrate of the intermediate transfer body 1 or that of the surface layer 2 exhibiting the lyophilic property and then lyophobic elements are introduced into a non-masked portion 30 by the energy irradiation, whereby the lyophobic sections 23 are formed. In this case, means for irradiating energy is, for example, a plasma irradiation using gas containing fluorine atoms or a metallizing.

FIGS. 12A to 12D illustrate a process wherein after forming a lyophobic coating 30 on a substrate of the intermediate transfer body 1 or that of the surface layer 2 thereof exhibiting the lyophilic property, the lyophilic sections are partially exposed by laser beams from a laser device 31 to be the lyophobic sections 23. In this regard, if the lyophobic sections are formed of organic resist, it is also possible to more enhance the lyophobic property by the plasma processing using gas containing fluorine atoms.

The above-mentioned methods are also usable in the same manner when the lyophilic sections are formed on the substrate of the intermediate transfer body 1 or that of the surface layer 2 formed of lyophobic material.

For instance, in FIGS. 13A to 13D, a mask 28 is disposed on a substrate of the intermediate transfer body 1 or the surface layer 2 thereof, through which is irradiated energy to introduce lyophilic functional groups into the non-masked portion 30, whereby the lyophilic sections 2 is formed. Means for irradiating energy used in such a case is, for example, a plasma processing using gas containing oxygen atoms. Also, as the lyophobic substrate, silicone rubber, fluorine rubber, fluoro-silicone rubber or others is suitably used.

Figure 15A:
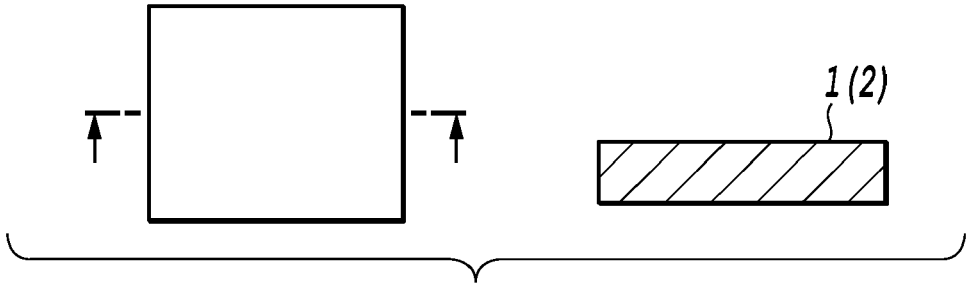
FIGS. 15A to 15D illustrate one example of a method for forming the lyophilic/lyophobic pattern on the intermediate transfer body.
Figure 15B:
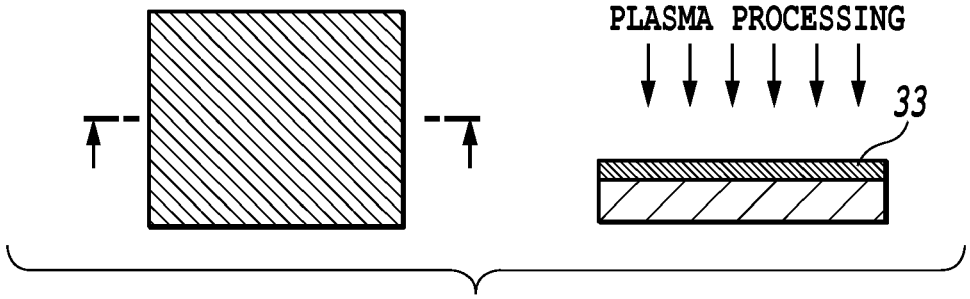
Figure 15C:
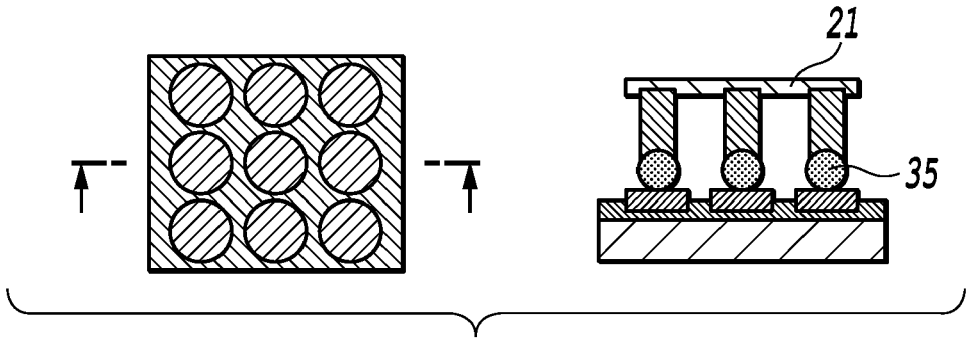
Figure 15D:
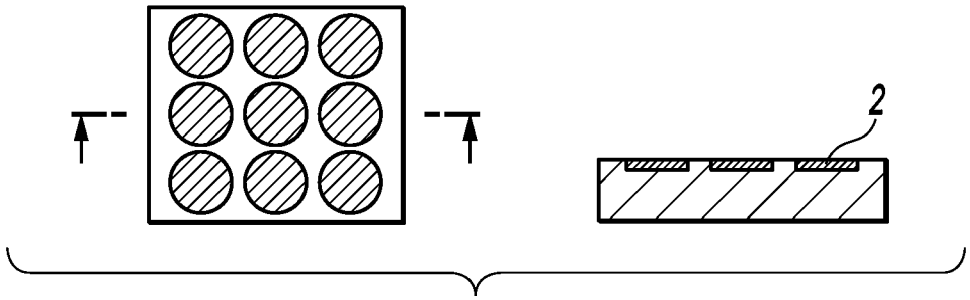

FIGS. 14A to 14D illustrate a process wherein after a surface-treated portion 33 is formed on the lyophobic substrate of the intermediate transfer body 1 or the surface layer 2 thereof, surfactant 35 is selectively applied thereto by using an ink jet recording device 34. Then, after the time has passed, the lyophilic property disappears in areas other than sections applied with surfactant, whereby the lyophilic sections 2 are formed. FIG. 15A to 15D illustrate a process similar to that shown in FIGS. 14A to 14D, except that surfactant 35 is applied by a printing form plate 21 (FIG. 15C).

While the methods for forming lyophobic sections on the substrate exhibiting the lyophilic property as well as for forming lyophilic sections on the substrate exhibiting the lyophobic property have been described above, it is also possible to properly combine them with each other to form the lyophilic sections and the lyophobic sections on the substrate. Alternatively, material lyophilized by a light may be mixed in the intermittent transfer body or used for forming the surface thereof, after which it is partially lyophilized by the irradiation of light.

The lyophobic section and the lyophilic section are preferably formed so that there is no height difference between the both. Ideally, the lyophobic and lyophilic sections are positioned in the same plane. This is because both of the ink transferring ability and the cleaning ability are facilitated. Contrarily, there are drawbacks in that the ink-reception amount is lowered or the dot gain is increased when the image is transferred (a phenomenon in that an ink dot is collapsed due to a pressure during the transfer to enlarge the diameter thereof whereby the resolution deteriorates). Such problems are solved by the supply of an image-holding component described later or the application of the water removal facilitating device 7 shown in FIG. 1. Alternatively, a plurality of intermediate transfer bodies for different colors respectively may be used for solving the above problems.

To make the lyophobic and lyophilic sections to define the same plane, the above-mentioned methods may be suitably combined with each other so that the lyophilic and lyophobic sections are formed on the substrate, or the methods shown in FIGS. 14 and 15 may be adopted.

Reactive Liquid

The reactive liquid is properly be chosen according to the kind of ink used for image forming. For a dye ink, for instance, it is effective to use a polymer coagulant. For a pigment ink having fine dispersed particles, it is effective to use a metal ion. Further, if the dye ink containing the image-holding component having a combination of the polymer coagulant with the metal ion is used, it is preferred that a pigment component of an identical color with that of the dye component be mixed into the ink, or that white or transparent fine particles which have little effects on the color be added.

The polymer coagulants used as the reactive liquid include, for example, cationic polymer coagulants, anionic polymer coagulants, nonionic polymer coagulants and amphoteric polymer coagulants. Metal ions include, for example, divalent metal ions such as $Ca^{2+}$, $Cu^{2+}$, $Ni^{2+}$, $Mg^{2+}$ and $Zn^{2+}$, and trivalent metal ions such as $Fe^{3+}$ and $Al^{3+}$. If a liquid containing these metal ions is applied, it is preferably applied in the form of a metal salt solution in water. Among anions of metal salts are $Cl^-$, $NO_3^-$, $SO_4^{2-}$, $I^-$, $Br^-$, $ClO_3^-$ and $RCOO^-$ (R represents an alkyl group). Material having a property reverse to the used ink is usable as the image-holding component. For example, if the ink is anionic or alkaline, cationic or acidic material is usable as a reactive liquid.

Figure 19:
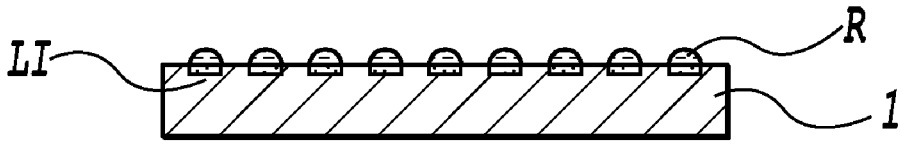
FIG. 19 illustrate a atate where an ink exists on the lyophilic pattern on the intermediate transfer body surface.

As described above, since the preferable lyophilic pattern is formed on the intermediate transfer body while means for applying the reactive liquid is not particularly limited, it is possible in the present invention to apply the reactive liquid in a stable and uniform manner by an extremely simple application device. As one instance thereof, the application device 3 of a roll coater type is illustrated in FIG. 1. The reactive liquid supplied from the coating roll is held solely on the lyophilic sections on the intermediate transfer body (see FIG. 19). That is, when the application of the reactive liquid is carried out by the coating roller, the reactive liquid is brought into contact with both of the lyophilic section and the lyophobic section but not received in the lyophobic section because the reactive liquid is rejected thereby. Accordingly, upon the formation of the image, almost of the reactive liquid exists in the lyophilic section as shown in FIG. 19. Although an application amount of the reactive liquid by the coating roll is relied on a surface tension of the reactive liquid relative to a pattern, and if the coating condition is constant, a constant amount of reactive liquid is automatically received by the intermediate transfer body 1 according to the lyophilic pattern. Also, since the fluidity of the reactive liquid can be restricted by a fine lyophilic pattern, it is possible to carry out the uniform application free from the nonuniformity within the surface of the intermediate transfer body.

In this regard, as other coating methods, a contact type such as a doctor coat, a dye coat, a wire bar coat or a gravure roller coat, or a non-contact type such as a spray coat or a droplet coat by an ink jet head may be used. Although the adaptation range is limited, a spin coat, lifting-up coat or an air knife coat may be usable without problems in nature. The above-mentioned coating or application means may be suitably combined with each other.

2.2 Process (b): Process for Forming an Ink Image by the Ink Jet Head

When the ink jet system is adopted, there is no limitation in the ejection systems. For example, energy used for ejecting ink may be thermal energy (a thermal jet system) or mechanical energy (a piezo system). Other than the on-demand type, a continuous type ink jet recording system may be properly usable. Further, as a shape of the ink jet head, for example, in the structure shown in FIG. 1, a line head type may be used wherein ink jet ejection orifices are arranged in the axial direction of the intermediate transfer body 1 (vertical to the surface of the drawing). Alternatively, an ink jet head wherein ink ejection orifices are arranged in a predetermined range in the tangential direction or the circumferential direction of the intermediate transfer body 1 and the recording is carried out while scanning the same in the axial direction. In addition thereto, a plurality of heads corresponding to the number of ink colors used for forming an image may be used.

Also, there is no limitation in the image to be recorded, including, in addition to letters, illustrations and natural pictures, simple patterns or industrial patterns such as electronic circuits or others. When the image is formed, ink is ejected to form a mirror image by taking the reversal of image due to the transfer into account.

Although there is no limitation also in kinds of ink, an aqueous type containing dye or pigment is suitably used in general. Particular, the pigment ink is favorable when metallic salt is used in the reactive liquid.

There is no limitation in the usable dyes. Commonly used dyes may be adapted without problems. Among possible dyes are C.I. Direct Blue 6, 8, 22, 34, 70, 71, 76, 78, 86, 142, 199, C.I. Acid Blue 9, 22, 40, 59, 93, 102, 104, 117, 120, 167, 229, C.I. Direct Red 1, 4, 17, 28, 83, 227, C.I. Acid Red 1, 4, 8, 13, 14, 15, 18, 21, 26, 35, 37, 249, 257, 289, C.I. Direct Yellow 12, 24, 26, 86, 98, 132, 142, C.I. Acid Yellow 1, 3, 4, 7, 11, 12, 13, 14, 19, 23, 25, 34, 44, 71, C.I. Food Black 1, 2, and C.I. Acid Black 2, 7, 24, 26, 31, 52, 112, 118.

There is no limitation in the usable pigments. Commonly used pigments may be adapted without problems. Among possible pigments are C.I. Pigment Blue 1, 2, 3, 15:3, 16, 22, C.I. Pigment Red 5, 7, 12, 48 (Ca), 48 (Mn), 57 (Ca), 112, 122, C.I. Pigment Yellow 1, 2, 3, 13, 16, 83, Carbon Black No. 2300, 900, 33, 40, 52, MA 7, 8, MCF 88 (Mitsubishi Kasei make), RAVEN1255 (Columbia make), REGAL330R, 660R, MOGUL (Cabotmake), ColorBlackFW1, FW18, S170, S150, and Printex35 (Degussa make).

These pigments are free from any limitations in terms of application mode. They can be used in the form of, for instance, self dispersion type, resin dispersion type and microcapsule type. Suitable pigment dispersions include a water-soluble dispersion resin with a weight-averaged molecular weight of about 1,000 to 15,000. More specifically, they include block or random copolymers and salts thereof made from styrene and its derivatives, vinylnaphthalene and its derivatives, aliphatic alcohol esters of $\alpha,\beta$-ethylenically-unsaturated carboxylic acid, acrylic acid and its derivatives, maleic acid and its derivatives, itaconic acid and its derivatives, or fumaric acid and its derivatives.

To improve the durability of the image formed, a water-soluble resin and a water-soluble cross-linking agent may be added. The only requirement for these materials is that they can coexist with ink components. As the water-soluble resin, the above-mentioned dispersion resins may be suitably used. As the water-soluble cross-linking agent, oxazoline and carbodiimide, which have slow responsivity, may be suitably used in terms of ink stability.

(Partially Eliminated.)

An amount of organic solvent in the ink becomes a factor for deciding the ejection ability or the dry characteristics of ink. Since the ink almost consists of colorant and organic solvent having a high boiling point when transferred to the recording medium 9, the ink is designed to have an optimum value thereof. The organic solvent used is preferably water-soluble material having a high boiling point and a low vapor pressure. The organic solvents may include, for example, polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether or glycerin. To adjust viscosity and surface tension, alcohols such as ethyl alcohol and isopropyl alcohol may be added to ink.

As for a compounding ratio of components making up the ink, there is no limitation. The compounding ratio can be adjusted properly according to the chosen ejection force and nozzle diameters of the ink jet head. The ink may, for example, be composed of 0.1-10% colorant, 0.1-10% resinous component, 5-40% solvent, 0.1-5% surface active agent and the remaining percentage of purified water.

The fluidity of the above-mentioned ink lowers when it is ejected from the ink jet head and brought into contact with the reactive liquid on the intermediate transfer body. Accordingly, the bleeding or beading is prevented from occurring. Also, since the reactive liquid on the intermediate transfer body is controlled to be thin and uniform, the disturbance of the image is prevented from occurring. Furthermore, due to the effect of the lyophobic sections arranged on the intermediate transfer body at a constant pitch, the deviation of the ink image on the intermediate transfer body hardly occurs in the processes until the transfer has been completed, whereby a high-quality image is maintained.

Figure 20:
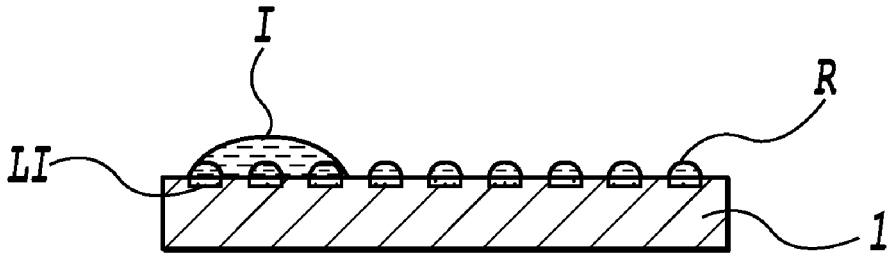
FIG. 20 illustrate an atate where an ink is applied onto the reactive liquid which exists along the lyophilic pattern.

Here, the application of ink to the reactive liquid existing on the lyophilic pattern on the surface of the intermediate transfer body will be described with reference to FIG. 20. As described above, the reactive liquid applied to the intermediate transfer body in the process (a) exists solely on part of the surface of the intermediate transfer body along the lyophilic pattern as shown in FIG. 19. In process (b), while the ink is applied to the reactive liquid in such a state (see FIG. 20), the moving range of the ink is limited because the existence of the reactive liquid is restricted to part of the surface of the transfer body. Particularly, if a diameter of the ink dot is larger than a width of the element of the lyophilic section, the ink dot becomes larger than the reactive liquid dot as shown in FIG. 20, whereby the ink does not move in a relatively wider range as shown in FIG. 18. In a case of FIG. 20, since there is hardly a free surface wherein ink is movable and micro-dots of reactive liquid act as an ink-movement restricting section, the ink movement can be smaller in comparison with the state shown in FIG. 18. Accordingly, it is possible to form a high-quality image free from the disturbance of ink image caused by the ink movement.

2.3 Process (c): Process for Transferring Ink Image on Intermediate Transfer Body to Recording Medium.

The image formed of ink condensed on the intermediate transfer body is transferred to the recording medium. The recording medium 9 is in contact with the image-forming surface of the intermediate transfer body 1 by the pressure roller 10 and receives the ink. Here, when an amount of ink applied to the intermediate transfer body is large, there may be a case wherein the image is disturbed due to the transfer pressure. To reduce this, it is favorable that the water in the ink is reduced to reduce a volume of ink prior to the transfer. Since this ink contains a large amount of water, the volume thereof reduces within a range from about ⅕ to ⅒ of the original volume after the above water removal. Thereby, it is possible to form a favorable image even on a recording medium having less or no absorbency. Also, the ink having a higher viscosity (the condensed ink) due to the water removal is excellent in transferring efficiency and thus capable of reducing the residual ink on the intermediate transfer body.

Further, if a thin paper is used as a recording medium, it is possible to restrict the waving of the paper caused by the water absorption.

To reduce the volume, it is also possible to decelerate the rotational speed of the intermediate transfer body 1 so that a time necessary for evaporating the water is ensured. However, in view of cases wherein a high speed recording is required, it is effective to provide a water removing process provided with the water removal facilitating device 7 and/or the heat roller 8 as shown in FIG. 1. While the water removal facilitating device 7 of a blower type and the heat roller 8 of a type in contact with a rear surface of the hollow intermediate transfer body 1 to heat the latter due to the heat conduction are illustrated in the drawing, other means for removing water may, of course, be employable. For instance, a heat source irradiating heat rays or blowing hot air to facilitate the evaporation may be used.

In the structure shown in FIG. 1, it is also possible to instantly provide the fastness and the luster to the image recorded on the recording medium by touching a heat roller or others thereto.

In the structure shown in FIG. 1, ink or dust such as paper powder remaining on the intermediate transfer body after the image is transferred is removed by rinsing the surface of the intermediate transfer body with the cleaning unit 12. The rinsing means is preferably direct rinsing means wherein the intermediate transfer body is fed with water in a shower-like manner or is brought into contact with a water surface, or means for wiping the surface with a wet molten roller. Of course, these may be combined with each other. Further, if necessary, it is effective that a dry molten roller or a rubber wiper is brought into contact with the intermediate transfer body or air is fed thereto after the rinsing to instantly dry the surface of the intermediate transfer body. The surface of the intermediate transfer body is preferably less in concave or convex to facilitate the cleanability at that time.

3. EXAMPLES

Then, more concrete examples of the present invention and comparative examples thereof will be explained. In the following description, part or % is based on a weight unless there is another definition.

(3.1) Example 1

(a) Process for Applying Reactive Liquid to Intermediate Transfer Body

In this example, as a substrate for the surface of the intermediate transfer body, a PET film of 0.4 mm thick coated with silicone rubber having a rubber hardness of 40° (manufactured by SHIN-ETSU KAGAKU; KE12) of 0.3 mm thick was used. A regular pattern consisting of lyophilic and lyophobic sections were formed on this surface.

First, a substrate of the intermediate transfer body was surface-treated to be lyophilic by a parallel plate type atmospheric pressure plasma-processing device (manufactured by SEKISUI KAGAKU; APT-203), then coated all over the surface with 3% PVA aqueous solution (manufactured by KURARE; 403) by a roll coater, and dried.

The surface was irradiated with excimer laser beams in a spotted manner to remove the PVA layer for forming the lyophilic section. According to this example, circles of 10 μm diameter were regularly arranged at a pitch of 20 μm (see FIG. 3A).

The surface of the substrate of the intermediate transfer body was modified again by the parallel plate type plasma-processing device under the following condition:

(Condition of Surface Modification)

| | |
|---|---|
| Kind and flow rate of used gas: | air; flow 1000 cc/min<br>$N_2$; flow 6000 cc/min |
| Input voltage: | 230 V |
| Frequency: | 10 kHz |
| Processing speed: | 200 mm/min |

Then, the surface was rinsed with 5% aqueous solution of surfactant (manufactured by NIPPON UNICAR; Silwet L77). At that time, the PVA layer which is a water-soluble layer was dissolved and removed.

The lyophilic sections were formed on the rinsed substrate for the surface layer of the intermediate transfer body thus produced had a desired lyophilic/lyophobic pattern wherein the portions treated with the excimer laser beams solely form the lyophilic sections.

The substrate for the surface layer was wound around an aluminum drum used as a support for the intermittent transfer body, and the body thus obtained was then fixed to the image-forming apparatus.

Next, reactive liquid having the following composition was applied on the intermediate transfer body using a roll coater.

(Composition of Reactive Liquid)

| | |
|---|---|
| $CaCl_2 \cdot 2H_2O$: | 10% |
| Surfactant (manufactured by KAWASAKI FINE CHEMICALS: Acetilenol EH): | 1% |
| Diethylene glycol: | 30% |
| Pure water: | 59% |

(b) Process for Forming Ink Image on Intermediate Transfer Body

A mirror-reversed letter image was formed on the intermediate transfer body applied with reactive liquid, with four color inks of the following recipe containing pigments of the respective colors by using the ink jet device (a nozzle arrangement density of 1200 dpi, an ejection rate of 4.0 μl and a driving frequency of 12 kHz):

(Ink Recipe)

| Pigments: 3 parts | |
|---|---|
| Black: Carbon Black (manufactured by MITSUBISHI KAGAKU: MCF88) | |
| Cyan: Pigment Blue 15 | |
| Magenta: Pigment Red 7 | |
| Yellow: Pigment Yellow 74 | |
| Styrene/acrylic acid/ethyl acrylate copolymer (acid value of 240, weight-average molecular weight of 5000): | 1 part |
| Glycerin: | 10 parts |
| Ethylene glycol: | 5 parts |
| Surfactant (manufactured by KAWAKEN FINE CHEMICALS: Acetylenol FH): | 1 part |
| Ion-exchanged water: | 80 parts |

No beading and bleeding occurred when the ink image was formed on the intermediate transfer body. Further, a diameter of landed ink droplet ejected from the ink jet recording device was approximately 40 μm.

(c) Process for Transferring Ink Image to Recording Medium

After the water in the ink image on the intermediate transfer body was removed to lower the fluidity of the ink, the image was transferred to a recording medium (manufactured by NIPPON SEISHI: Aurora Coat; a ream weight of 40.5) while being in contact with a pressure roller. As a result, it was confirmed that a high-quality image is recorded on the recording medium. Also, ink hardly remained on the intermediate transfer body after the transferring, whereby there was no adverse effect on the subsequently received image.

3.2 Example 2

(a) Process for Applying Reactive Liquid to Intermediate Transfer Body

In this example, PET film of 0.4 mm thick coated with silicone rubber (manufactured by SHIN-ETSU KAGAKU; KE 30) of 0.3 mm having a rubber hardness of 60° was used as a substrate for the surface layer of the intermediate transfer body. A regular pattern of lyophilic and lyophobic sections was formed on this surface.

Initially, the surface of the substrate for the surface layer of the intermediate transfer body was treated to be lyophilic using a parallel plate type atmospheric pressure plasma processing device (manufactured by SEKISUI KAGAKU: APT-203), then coated with positive type photosensitive resist (manufactured by HOECHST: AZ-4903) to be 0.3 μm thick, which was then exposed and developed by a predetermined photolithographic method to obtain a resist pattern. According to this example, a lattice type pattern was obtained by arranging straight lines of 10 μm wide at a pitch of 50 μm (see FIG. 4C).

The surface of the substrate for the surface layer of the intermediate transfer body was modified again by the parallel plate type plasma processing device under the following condition:

(Surface Modifying Condition)

| | |
|---|---|
| Kind and flow rate of used gas: | air; 1000 cc/min<br>$N_2$; 5000 cc/min |
| Input voltage: | 260 V |
| Frequency: | 17.5 kHz |
| Processing speed: | 500 m/min |

Next, the surface was coated with 10% aqueous solution of surfactant (manufactured by SEIMI CHEMICAL: Surflon S111).

Then, after the ultraviolet ray was irradiated to the surface to decompose the resist, the alkaline development was carried out on the surface. The substrate for the surface layer of the intermediate transfer body thus obtained had a desired pattern of lyophilic/lyophobic sections wherein openings in the resist pattern solely form the lyophilic sections.

The substrate for the surface layer was wound around an aluminum drum used as the intermediate transfer body which is then fixed to the image-forming apparatus.

Next, the intermediate transfer body was applied with reactive liquid of the following composition by using a roll coater.

(Composition of Reactive Liquid)

| | |
|---|---|
| $MgNO_3 \cdot 6H_2O$: | 15% |
| Surfactant (manufactured by KAWAKEN FINE CHEMICAL; Acetylenol EH): | 1% |
| Diethylene glycol: | 20% |
| Hexylene glycol: | 10% |
| Pure water: | 54% |

Next, a mirror-reversal photographic image was formed on the intermediate transfer body with four color inks (containing the respective pigments as colorant) of the following recipe using an ink jet recording apparatus (a nozzle arrangement density of 1200 dpi, an ejection rate of 4 μl, and a driving frequency of 8 kHz)

(Ink Recipe)

| The following pigments: each 5 parts | |
|---|---|
| Black: carbon black (manufactured by Mitsubishi Chemicals: MCF 88) | |
| Cyan: Pigment Blue 15 | |
| Magenta: Pigment Red 7 | |
| Yellow: Pigment Yellow 74 | |
| Styrene/acrylic acid/ethyl acrylate copolymer (acid value of 240, weight-average molecular weight of 5000): | 1 part |
| Glycerin: | 10 parts |
| Ethylene glycol: | 5 parts |
| Surfactant (manufactured by KAWAKEN Fine Cemicals: Acetylenol EH): | 1 part |
| Ion exchanging water: | 78 parts |

As a result, there was no deformation of letter when the recorded image is formed on the intermediate transfer body.

(c) Process for Transferring Ink Image to Recording Medium

An ink image on the intermediate transfer body was brought into contact with a recording medium (manufactured by NIPPON SEISHI: Aurora Coat a ream weight of 40.5) by a pressure roller, whereby a high-quality letter was recorded thereon. Ink hardly remained on the intermediate transfer body after the transferring, whereby there was no adverse effect on the subsequently received image.

3.3 Comparative Example 1

By using the same intermediate transfer body as in Example 1, except for using, as a surface layer, silicone rubber irradiated with plasma all over the surface thereof so that no regular pattern consisting of lyophilic and lyophobic sections is formed, the image recording was carried out. As a result, there was the deformation of micro-letters, and the stability was somewhat unstable in comparison with Example 1 when the image was repeatedly output.

3.4 Comparative Example 2

By using, as a surface layer, silicone rubber non-treated all over the surface thereof so that no regular pattern consisting of lyophilic and lyophobic sections is formed, the image recording was carried out. As a result, the reactive liquid was not held on desired positions on the intermediate transfer body whereby the image was deformed due to the bleeding and the beading, as well as the image transferred to the recording medium was also very inferior.

4. Example of Control System and Control Procedure

In constructing the image forming apparatus of FIG. 1 using various units employed in the above Example 1 or 2, the control system may be formed as described below.

Figure 16:
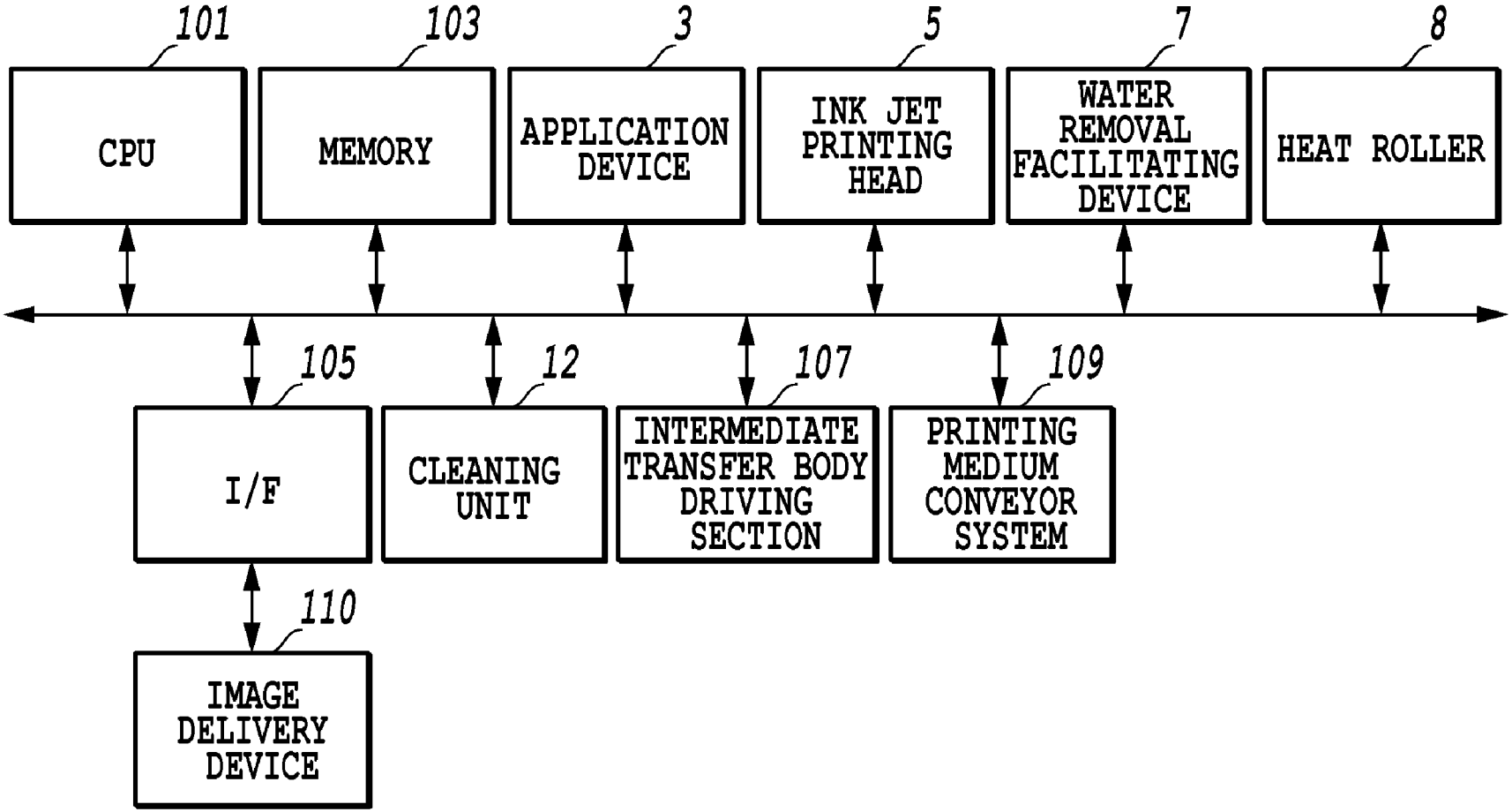
FIG. 16 is a block diagram illustrating one example of a control system constituted in correspondence to the image recording device shown in FIG. 1.

FIG. 16 shows an example configuration of a control system that may be built for the image forming apparatus of FIG. 1. In the image forming apparatus, reference number 101 represents a CPU, a main control unit for the entire system. Denoted 103 is a memory including a ROM storing an operating system of CPU 101 and a RAM used to temporarily store a variety of data and to process image data and other works. Denoted 105 is an interface to send and receive data and commands to and from an image source device 110, a source of image data which may take a form of a host computer or others.

Designated 107 is a drive unit for driving the intermediate transfer body 1 in the processes (a) to (c). Reference number 109 represents a conveyer system for a recording medium 10 and includes drive units for the pressure roller 10 and the fixing rollers 11. A bus line 120 interconnects the aforementioned components and also an energy application device 3, which may take one of the forms described in the above embodiments, the application device 3, the ink jet head 5, the water removal facilitating device 7, the heat roller 8 and the cleaning unit 12 and sends control signals from the CPU 101. These components may be provided with status sensors so that detected signals are transmitted to the CPU 101 through the bus line 120.

Figure 17:
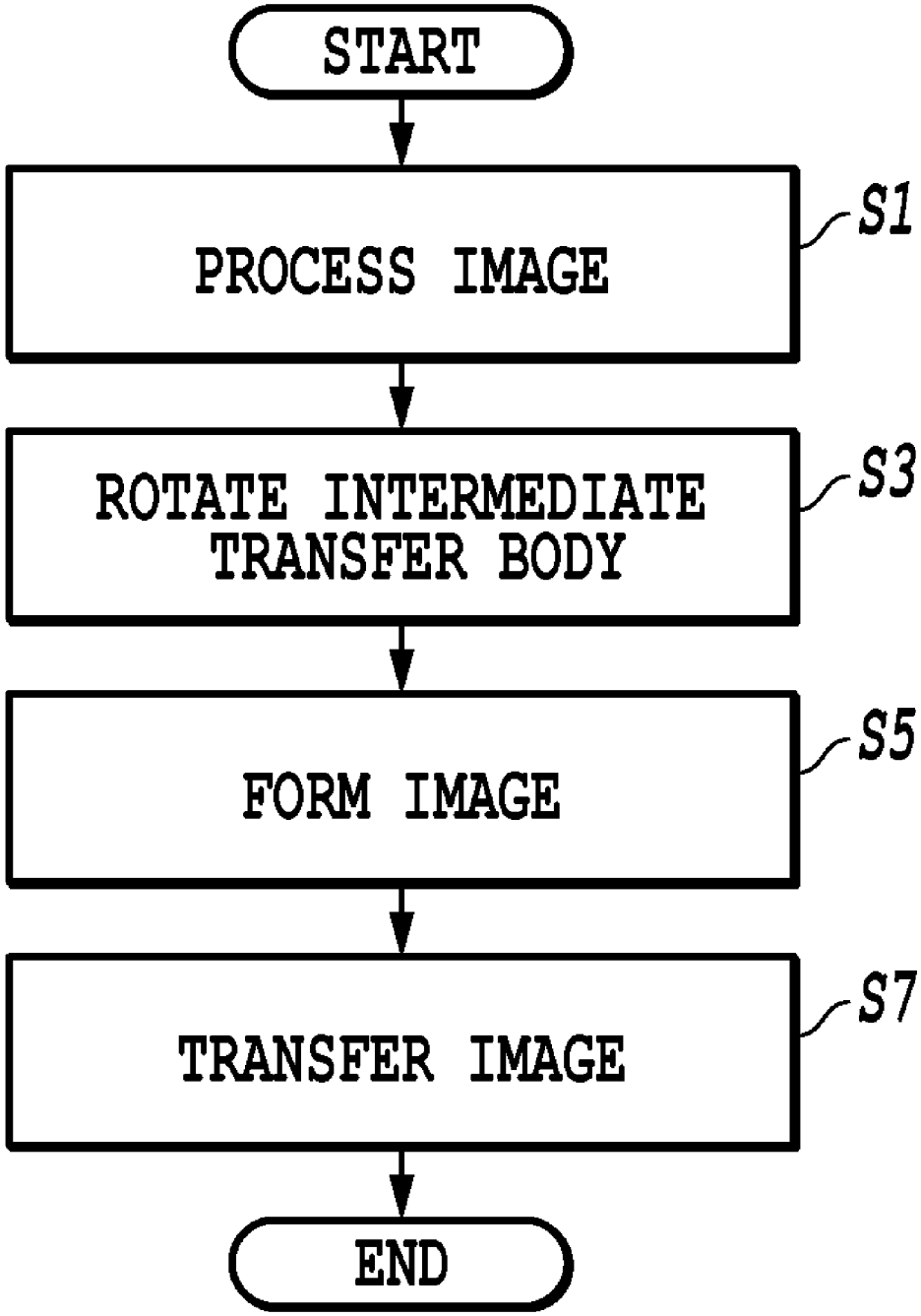
FIG. 17 is a flow chart illustrating one example of a series of processes for recording an image by using the control system shown in FIG. 16.

FIG. 17 shows a flow chart showing an example procedure of image forming process using the above control system.

When image data is received from the image source device 110 and the recording of that image data is specified, predetermined image processing is performed on the image data so that the ink jet head 5 can form an image (step S1). If the image data sent from the image source device is not mirror-inverted data, this image processing can include the inversion processing.

When the ink jet head 5 is ready to record, the intermediate transfer body 1 is rotated (step S3), which is followed by the driving of the application device 3 associated with the application process (a) for applying the reactive liquid on the intermediate transfer body 1 and the driving of the ink jet head 5 associated with the image forming process (b) for forming an image on the intermediate transfer body 1 (step S5). As described before, the reactive liquid applied to the intermediate transfer body in process (a) exists along the lyophilic pattern on the intermediate transfer body as shown in FIG. 19. In process (b), ink is applied to the intermediate transfer body in such a state (see FIG. 20). Since the movement of ink is restricted by the dots of reactive liquid, ink hardly moves from the landing point. Thus, a high-quality ink image free from the error of the ink landing is formed on the intermediate transfer body. Further, the step S5 is followed by the driving of the water removal facilitating device 7, the heat roller 8, the recording medium conveyer system 109 and the cleaning unit 12, all associated with the process (c) for transferring the ink image onto the recording medium. These components are synchronously driven to ensure that the reactive liquid is applied for good image forming and that the position of the formed image and the transferred image position on the recording medium are aligned correctly. If the ink jet head 5 is of a serial printing type, the image forming is done by alternating the main scan of the ink jet head and the rotation over a predetermined distance of the intermediate transfer body 1. When the processing of the specified amount of image data is completed, this procedure is exited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-168006 filed Jun. 16, 2006, which is hereby incorporated by reference herein in its entirety.

The invention claimed is:

1. A method for producing a record product as a recording medium on which an ink image is formed, the method comprising the steps of:

applying reactive liquid reactable with ink onto an intermediate transfer body having a pattern consisting of lyophilic sections and lyophobic sections at a surface thereof;

forming an ink image on the intermediate transfer body by ejecting the ink from an ink jet head to the intermediate transfer body applied with the reactive liquid; and transferring the ink image formed on the intermediate transfer body to a recording medium, wherein a width of an element of the lyophilic section constituting the pattern is not larger than a diameter of an ink dot for forming the ink image.

2. A method for producing a record product as a recording medium on which an ink image is formed, the method comprising the steps of:

applying reactive liquid reactable with ink onto an intermediate transfer body having a pattern consisting of lyophilic sections and lyophobic sections at a surface thereof;

forming an ink image on the intermediate transfer body by ejecting the ink from an ink jet head to the intermediate transfer body applied with the reactive liquid; and transferring the ink image formed on the intermediate transfer body to a recording medium, wherein elements of the lyophilic section constituting the pattern are arranged at a pitch that is twice a diameter of an ink dot for forming the ink image or less.

3. A method as claimed in claim 1, wherein a material of the surface having the lyophilic and lyophobic sections is silicone rubber.

4. A method as claimed in claim 1, wherein the lyophilic and lyophobic sections are formed to define the same plane.

5. A method as claimed in claim 1, wherein the ink is aqueous type pigment ink.

6. A method as claimed in claim 1, wherein the reactive liquid contains metallic salt.

7. A method for producing a record product as a recording medium on which an ink image is formed, the method comprising the steps of:

applying reactive liquid reactable with ink onto an intermediate transfer body having a pattern consisting of lyophilic sections and lyophobic sections at a surface thereof;

forming an ink image on the intermediate transfer body by ejecting the ink from an ink jet head to the intermediate transfer body where the applied reactive liquid exists on the lyophilic section; and transferring the ink image formed on the intermediate transfer body to a recording medium, wherein the reactive liquid is applied so that a diameter of a reactive liquid dot in the lyophilic section is smaller than a diameter of an ink dot for forming the ink image.

8. An image recording apparatus comprising:

an intermediate transfer body having a pattern consisting of lyophilic sections and lyophobic sections at a surface thereof;

an applying device that applies reactive liquid reactable with ink onto the intermediate transfer body;

an ink jet head that ejects ink to the intermediate transfer body applied with the reactive liquid; and a transfer section that transfers the ink ejected to the intermediate transfer body to a recording medium, wherein a width of an element of the lyophilic section constituting the pattern is not larger than a diameter of an ink dot for forming the ink image.

* * * * *